US008682212B2

(12) United States Patent
Kikuchi et al.

(10) Patent No.: US 8,682,212 B2
(45) Date of Patent: Mar. 25, 2014

(54) ELECTROPHOTOGRAPHIC IMAGE FORMING APPARATUS

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 12/727,646

(22) Filed: Mar. 19, 2010

(65) Prior Publication Data

US 2010/0247138 A1 Sep. 30, 2010

(30) Foreign Application Priority Data

Mar. 26, 2009 (JP) ..... 2009-076149
Mar. 3, 2010 (JP) ..... 2010-046360

(51) Int. Cl.
*G03G 15/00* (2006.01)

(52) U.S. Cl.
USPC ..... 399/110; 399/299

(58) Field of Classification Search
USPC ..... 399/110, 111, 300, 299
See application file for complete search history.

(56) References Cited

U.S. PATENT DOCUMENTS

| | | | | |
|---|---|---|---|---|
| 6,141,513 | A | 10/2000 | Nishiuwatoko et al. | |
| 6,236,820 | B1 | 5/2001 | Nakazato et al. | |
| 6,336,012 | B1 | 1/2002 | Noda et al. | |
| 6,366,746 | B1 | 4/2002 | Sasago et al. | |
| 6,385,413 | B2 | 5/2002 | Sasaki et al. | |
| 6,606,469 | B2 | 8/2003 | Kikuchi et al. | |
| 6,968,138 | B2 | 11/2005 | Akutsu | |
| 7,567,769 | B2 | 7/2009 | Noguchi et al. | |
| 7,801,462 | B2 | 9/2010 | Nakazato et al. | |
| 2003/0053819 | A1 | 3/2003 | Nomura et al. | |
| 2007/0071494 | A1 * | 3/2007 | Igarashi et al. | 399/110 |
| 2007/0147890 | A1 | 6/2007 | Hayakawa | |
| 2007/0160380 | A1 | 7/2007 | Imaizumi et al. | |
| 2007/0160386 | A1 | 7/2007 | Kawamura | |
| 2008/0159781 | A1 | 7/2008 | Noguchi et al. | |
| 2008/0181658 | A1 | 7/2008 | Okabe | |
| 2009/0060569 | A1 | 3/2009 | Nakazato et al. | |
| 2010/0329733 | A1 | 12/2010 | Nakazato et al. | |

FOREIGN PATENT DOCUMENTS

| | | | |
|---|---|---|---|
| JP | 2000-035702 | A | 2/2000 |
| JP | 2001-109358 | A | 4/2001 |
| JP | 2005-157113 | A | 6/2005 |
| JP | 2006-184901 | A | 7/2006 |
| JP | 2008-165027 | A | 7/2008 |

OTHER PUBLICATIONS

Notification of Reason for Refusal dated Feb. 25, 2011, in counterpart Japanese Application No. 2010-046360.

* cited by examiner

*Primary Examiner* — Benjamin Schmitt
(74) *Attorney, Agent, or Firm* — Fitzpatrick, Cella, Harper & Scinto

(57) ABSTRACT

An electrophotographic image forming apparatus, in which a drawer supporting a cartridge is mounted in an apparatus main body, and an impact when a drawer is mounted into the apparatus main body may be suppressed to prevent a developer from scattering within a developer container. The drawer supporting the cartridge is movable between an inside position in the apparatus main body and a pullout position at which the cartridge is mounted and removed. On a forward side of the inside position, a force giving portion for giving a force to the drawer in a direction opposite to a mounting direction is provided. The force giving portion gives the force gradually to the drawer along with movement of the drawer in the mounting direction. With this structure, it is possible to suppress the scattering of the developer in the cartridge caused by the impact on mounting.

7 Claims, 14 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus, in which a plurality of cartridges are removably mounted to an apparatus main body to form an image on a recording medium. Here, the electrophotographic image forming apparatus forms an image on a recording medium by using an electrophotographic image forming process. Then, examples of the electrophotographic image forming apparatus include, for example, an electrophotographic copying machine, an electrophotographic printer (for example, such as a laser beam printer and an LED printer), a facsimile machine, and a word processor. Besides, the recording medium is one on which an image is formed by the electrophotographic image forming apparatus, and paper, an OHT sheet, and the like are included therein, for instance. Further, a cartridge is, for example, a process cartridge or a developing cartridge, and contributes, under a state being removably mounted to a main body of the electrophotographic image forming apparatus, to an image forming process for forming the image on the recording medium. Here, in the above-mentioned process cartridge, at least one of a charging means, a developing means, and a cleaning means each serving as a process means and an electrophotographic photosensitive drum are integrated into a cartridge, and the thus formed cartridge is removably mounted to the main body. Therefore, a process cartridge, in which the developing means serving as the process means and the electrophotographic photosensitive drum are integrated into a cartridge, and the thus formed cartridge is removably mounted to the main body of the electrophotographic image forming apparatus, is also included in the above-mentioned process cartridge. Note that, the process cartridge, which integrally includes the electrophotographic photosensitive drum and the developing means, is referred to as a so-called integral type. Further, the process cartridge, which integrally includes the electrophotographic photosensitive drum and the process means other than the developing means, is referred to as a so-called separation type. That is, the developing means is provided in a developing unit, which is different from the process cartridge, and the image formation is performed through a pair of the developing unit and the process cartridge. This is referred to as the so-called separation type. In this case, the process cartridge allows mounting to and detaching from the main body by a user him/herself. Accordingly, maintenance of the apparatus main body may easily be performed. Note that, the process means acts on the electrophotographic photosensitive drum. Further, the developing cartridge refers to one, which includes a developing roller, contains a developer (toner) used to develop an electrostatic latent image formed on the electrophotographic photosensitive drum by the developing roller, and is removably mounted to the main body. In a case of the developing cartridge, the electrophotographic photosensitive drum is mounted to the apparatus main body or a cartridge supporting member described below. Alternatively, the electrophotographic photosensitive drum is provided in the so-called separation type process cartridge (in this case, the process cartridge has no developing means). Note that, the developing cartridge also allows mounting to and detaching from the main body by the user him/herself. Therefore, the maintenance of the apparatus main body may easily be performed. Then, as the cartridge, the so-called integral type or the so-called separation type process cartridge may be used. Further, as the cartridge, the so-called separation type process cartridge and the developing cartridge may be used as a pair. Further, there may include a case in which, as the cartridge, the electrophotographic photosensitive drum is fixed and mounted to the apparatus main body or the cartridge supporting member described below, and the developing cartridge is detachably used so as to be capable of acting on the electrophotographic photosensitive drum. Still further, the process cartridge or the developer cartridge containing a developer (toner) to be replenished to the developing cartridge, etc., is included in the above-mentioned cartridge.

2. Description of the Related Art

Hitherto, there is known the electrophotographic image forming apparatus, which forms an image on the recording medium using the electrophotographic image forming process. In the electrophotographic image forming apparatus, there is known the above-mentioned process cartridge system. Alternatively, there is known a developing cartridge system, which is constructed only by the above-mentioned developing unit as a separate member from the photosensitive drum. There is also known the above-mentioned developer cartridge system containing the developer. The above-mentioned process cartridge system, developing cartridge system, and developer cartridge system are all inclusively referred to as the cartridge systems. Note that, the above-mentioned process cartridge and developing cartridge each include a developer containing portion for containing the developer (toner) used to develop the electrostatic latent image. There is known a structure in which, in order to facilitate the replacement of the developer by the user, the drawer mounting the cartridge is provided so that the replacement work of various cartridges may be performed by pulling out the drawer from the apparatus main body to a predetermined position (US Patent Application Publication No. 2007/0160386). Further, there is also known a structure in which, when the drawer is pushed-in the apparatus main body, a friction member is abutted on the side surfaces of the drawer, thereby suppressing the energy of the drawer (US Patent Application Publication No. 2008/0181658). With this structure, a moving speed at the time of moving the drawer by the user is lowered, to thereby relax an impact which the drawer receives from the apparatus main body.

SUMMARY OF THE INVENTION

The present invention further evolves the above-mentioned related art.

It is an object of the present invention to provide an electrophotographic image forming apparatus in which, when a cartridge support member, which moves, while supporting a cartridge, between an inside position and an outside position, is pushed-in an apparatus main body, a movement speed of the cartridge support member may be suppressed.

It is another object of the present invention to provide an electrophotographic image forming apparatus, in which operability at a time of pushing-in a cartridge support member into an apparatus main body is enhanced.

It is still another object of the present invention to provide an electrophotographic image forming apparatus, in which a resistance force resisting advancing of a cartridge support member in a push-in direction may be given.

Yet another object of the present invention is to provide an electrophotographic image forming apparatus, which realizes, when a cartridge support member is positioned into a main body, relaxation of an impact which a cartridge support member receives from the main body by lowering an advancing speed of the cartridge support member in a push-in direction.

Yet another object of the present invention is to provide an electrophotographic image forming apparatus, in which, when a user pushes-in a cartridge support member in a push-in direction, a push-in force may be assisted.

In order to achieve the above-mentioned objects, a representative structure of an electrophotographic image forming apparatus according to the present invention is an electrophotographic image forming apparatus, in which a cartridge is removably mounted to an apparatus main body to form an image on a recording medium, including: a cartridge support member, which moves, while supporting the cartridge, between an inside position, which is positioned at an inside of the apparatus main body, and is an image forming position at which the image is formed by the cartridge and an outside position which is positioned at an outside of the apparatus main body at which the cartridge is mounted and removed; a resistance force giving portion, which is provided to the apparatus main body, for giving, when pushing-in the cartridge support member from the outside position to the inside position, a resistance force resisting an advancing of the cartridge support member in a push-in direction, the resistance force becoming larger as the cartridge support member advances in the push-in direction; and a push-in force giving portion, which is disposed downstream of the resistance force giving portion in the push-in direction, for giving the push-in force with respect to the cartridge support member in the push-in direction.

According to the present invention, when the cartridge support member, which moves, while supporting the cartridge, between the inside position and the outside position, is pushed-in the apparatus main body, the movement speed of the cartridge support member may be suppressed.

According to the present invention, the operability at the time of pushing-in the cartridge support member into the apparatus main body may be enhanced.

According to the present invention, the resistance force resisting the advancing of the cartridge support member in the push-in direction may be given.

According to the present invention, when the cartridge support member is positioned into the main body, the relaxation of the impact which the cartridge support member receives from the main body may be achieved by lowering the advancing speed of the cartridge support member in the push-in direction.

According to the present invention, when the user pushes-in the cartridge support member in the push-in direction, the push-in force may be assisted.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of the present invention are described in detail with reference to the drawings. However, unless otherwise specifically described, dimensions, materials, shapes, relative arrangements, and the like of components described in the embodiments are not intended to limit a scope of the present invention thereto.

First Embodiment

General Schematic Structure of Electrophotographic Image Forming Apparatus

Figure 1A:
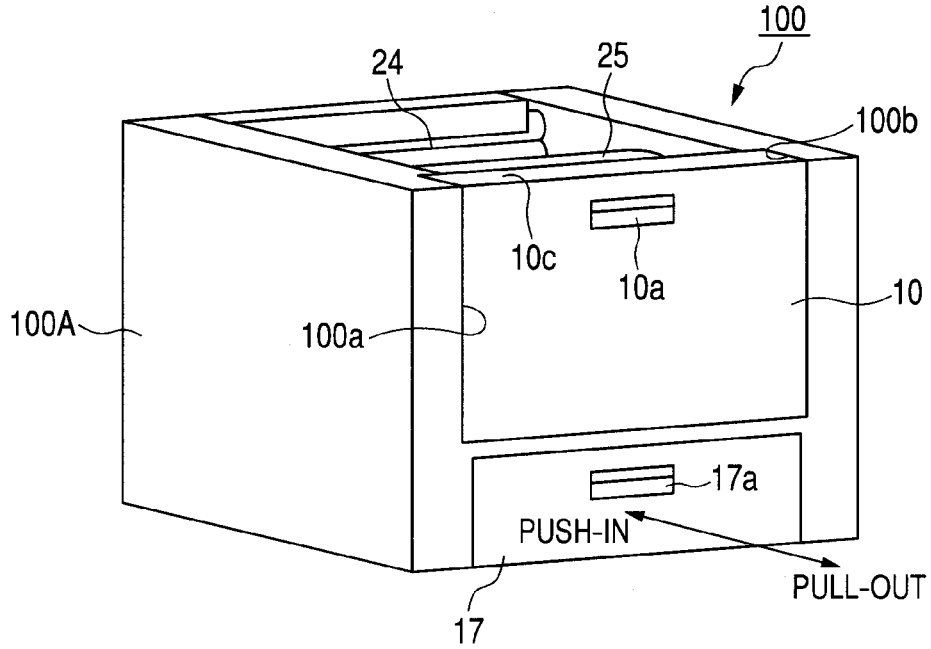
FIG. 1A is an appearance perspective view of an image forming apparatus according to a first embodiment of the present invention.
Figure 1B:
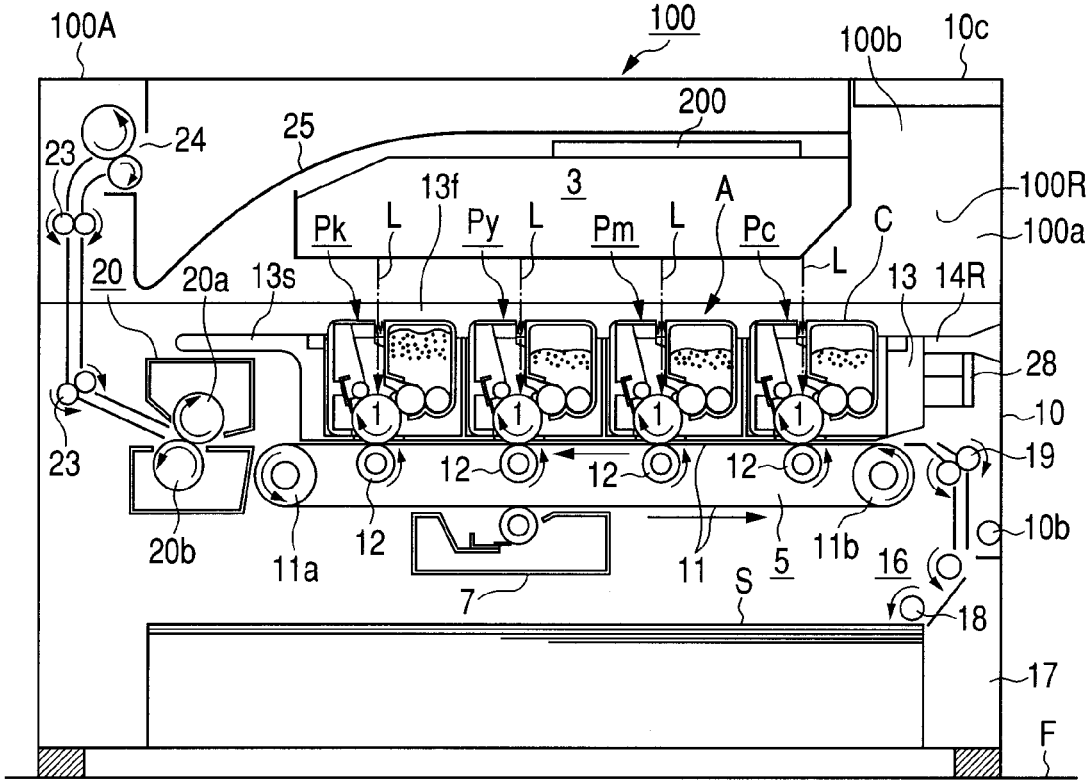
FIG. 1B is a vertical sectional right side view of the image forming apparatus.
Figure 2A:
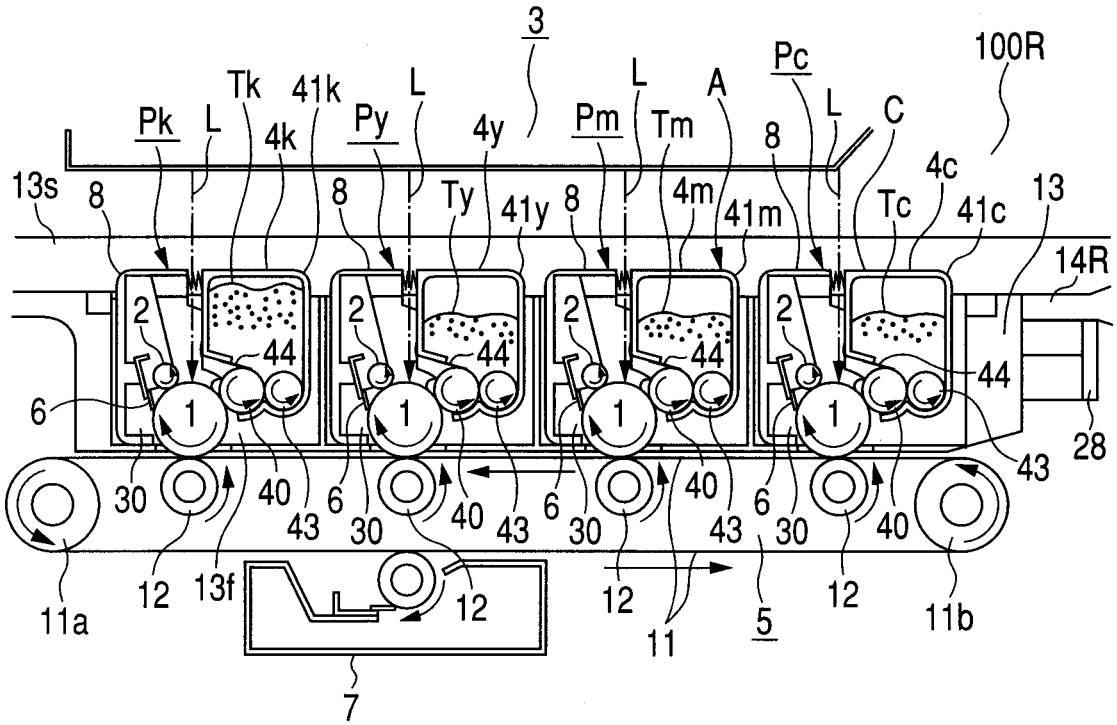
FIG. 2A is a partially enlarged view of FIG. 1B.

FIG. 1A is an external perspective view of a electrophotographic image forming apparatus (hereinafter, referred to as image forming apparatus) 100 viewed from its front side according to this embodiment, FIG. 1B is a schematic vertical sectional right side view of the image forming apparatus 100 according to this embodiment, and FIG. 2A is a partially enlarged view of FIG. 1B. The image forming apparatus 100 is a four-color full-color laser printer using an electrophotographic process. Specifically, the image forming apparatus 100 conducts a full color image formation with respect to a recording medium S on the basis of an electrical image signal, which is input from a host apparatus (not shown) such as a personal computer, an image reader, a facsimile on the other side, and the like to a control circuit portion 200. In the following description, regarding the image forming apparatus 100, a forward side or a front side refers to a side on which a door 10 for opening and closing the apparatus is arranged. A rear side refers to an opposite side thereto. A fore-and-aft direction refers to a direction from the rear side toward the front side of the image forming apparatus (forward direction), and an opposite direction thereto (backward direction). A left or right refers to a left or a right when the image forming apparatus is viewed from the front side. A lateral direction refers to a direction from right toward left (left-hand direction) and an opposite direction thereto (right-hand direction). Further, an apparatus main body 100A refers to an image forming apparatus portion excluding the cartridges and a drawer (a cartridge support member) 13 described later.

The image forming apparatus 100 is mounted on a substantially flat installation surface F such as a mounting table, a desk, or a floor. The image forming apparatus 100 described in this embodiment is a so-called lateral tandem type, in which four process cartridges P (Pk, Py, Pm, and Pc) for forming developer images (toner images) of respective black (k), yellow (y), magenta (m), and cyan (c) colors, are arranged in a lateral direction. In the image forming apparatus 100, the plurality of cartridges P are removably mounted to the apparatus main body 100A to form a color image on a recording medium S. Specifically, in an inside of the apparatus main body 100A, a first to fourth four process cartridges P (Pk, Py, Pm, and Pc) are arranged side-by-side substantially horizontally in order from a rear side to a front side. In this embodiment, each of the cartridges P is the so-called integral type process cartridge in which the electrophotographic photosensitive drum and the developing means are integrally provided. That is, each of the process cartridges P includes an electrophotographic photosensitive drum 1 (hereinafter, referred to as drum) on which an electrostatic latent image is formed. The drum 1 is rotatingly driven in clockwise as indicated by an arrow. At the periphery of the drum 1, a charging means 2, a developing means 4 (4*k*, 4*y*, 4*m*, and 4*c*), and a drum cleaning means 6 as process means acting on the drum are arranged in order in a rotation direction of the drum. The drum 1 is obtained by coating, for example, an organic photoconductive layer (OPC photoconductor) onto an outer peripheral surface of an aluminum cylinder. The charging means 2 employs a contact charging system, in which a charging roller (a conductive roller formed into a roller shape) is used as a charging member. The charging roller 2 is arranged substantially in parallel to and abutting the drum 1, and is rotated in association with the rotation of the drum 1. Then, the surface of the drum 1 is uniformly charged with a predetermined polarity and electric potential through an application of a predetermined charging bias voltage to the charging roller 2 from a power supply section (not shown). The developing means 4 is a device for developing the electrostatic latent image formed on the drum 1 by using a developer (toner). The respective developing units 4 (4*k*, 4*y*, 4*m*, and 4*c*) of the respective cartridges P include developer containing portions 41 (41*k*, 41*y*, 41*m*, and 41*c*) containing respective developers T (Tk, Ty, Tm, and Tc). Further, each of the developing units 4 includes a developing roller (developing member, developing means) 40 for developing a latent image formed on the drum 1. Further, each of the developing units 4 includes a developer supply roller (developer applying member) 43 for supplying a developer to the developing roller 40 and a developing blade for regulating a developer residual amount to be attached on an outer periphery of the developer roller 40 (developer regulating member) 44. The cleaning means (process means) 6 is means for removing a residual developer from a surface of the drum 1 after the transfer of the developer image formed on a peripheral surface of the drum 1 with respect to a recording medium S. In this embodiment, a cleaning blade (cleaning member) is used. The developer removed from the drum surface is received in a removed developer container portion 30. Each of the cartridges P is constructed by combining a photosensitive unit 8 including the drum 1, the charging roller 2, and a drum cleaning means 6 with the developing units 4. Then, the respective cartridges P are detachably replaceable with respect to the apparatus main body 100A with a drawer system. Further detailed structure of the cartridges P and the drawer system are described later.

A first cartridge Pk has a structure in which a powdered developer Tk of black color (k color) is contained in the developer containing portion 41*k* of the developing unit 4*k*, and a developer image of black color is formed on a surface of the drum 1. A second cartridge Py has a structure in which a powdered developer Ty of yellow color (y color) is contained in the developer containing portion 41*y* of the developing unit 4*y*, and a developer image of yellow color is formed on the drum 1. A third cartridge Pm has a structure in which a powdered developer Tm of magenta color (m color) is contained in the developer containing portion 41*m* of the developing unit 4*m*, and a developer image of magenta color is formed on the drum 1. A fourth cartridge Pc has a structure in which the powdered developer Tc of cyan color (c color) is contained in the developer containing portion 41*c* of the developing unit 4*c*, and a developer image of cyan color is formed on the drum 1. On an upper side of the cartridges P mounted inside of the apparatus main body 100A, a laser scanner unit (image exposing means) 3 is arranged. Besides, on the lower side thereof, an electrostatic transfer belt unit (transfer means) 5 is arranged. The unit 3 includes a laser diode, a polygon mirror, an f-θ lens, a reflection mirror, and the like. The unit 3 outputs a laser beam L which has been modulated in correspondence with image information of each color, which is input from a host apparatus to a control circuit portion 200, to thereby scan and expose a charging treatment surface of the drum 1. With this operation, an electrostatic latent image, which corresponds to a scanning and exposing pattern, is formed on the surface of the drum 1. The unit 5 includes an endless electrostatic transfer belt (hereinafter, referred to as a belt) 11, which is formed of a dielectric body and having a flexibility. Further, the electrostatic transfer belt unit 5 includes a first roller 11*a* of the rear side and a second roller 11*b* of the front side, around which the belt 11 are looped and stretched. In addition, the electrostatic transfer belt unit 5 includes four transfer rollers 12, which are arranged inside the belt 11 and between the first roller 11*a* and the second roller 11*b*, and are brought into pressure-contact with the drums 1 of the respective cartridges P, while sandwiching the belt 11 therebetween. In the respective cartridges P, a contact portion between the drum 1 and the belt 11 constitutes a transfer nip portion. When the first roller 11*a* is driven, the belt 11 rotates in a counterclockwise direction at a speed corresponding to a rotation speed of the drum 1. On the lower surface side of the belt 11, there is provided a belt cleaning means 7 for removing contaminant of the belt.

Operation for forming a full-color image is as follows. Each of the respective cartridges P is sequentially driven at predetermined control timing. Specifically, the respective drums 1 are rotatingly driven in a clockwise direction. The belt 11 of the electrostatic transfer belt unit 5 is also rotatingly driven. The laser scanner unit 3 is also driven. In synchronism with the drive, in the respective cartridges P, the charging roller uniformly charges the surface of the drum 1 to a predetermined polarity and predetermined potential. The laser scanner unit 3 carries out laser beam scanning exposure on the surfaces of the respective drums 1 in accordance with corresponding image signals. With this operation, electrostatic latent images are formed on the surfaces of the respective drums 1 in accordance with the corresponding image signals. The formed electrostatic latent images are developed with the developing units 4 (4*k*, 4*y*, 4*m*, and 4*c*) (developing rollers 40). That is, a developer image is formed. With the above-mentioned electrophotographic process operation, a developer image of black color corresponding to a black component image of a full-color image is formed on the drum 1 of the cartridge Pk. On the drum 1 of the cartridge Py, a developer image of yellow color corresponding to a yellow component image of a full-color image is formed. On the drum 1 of the cartridge Pm, a developer image of magenta color corresponding to a magenta component image of a full-color image is formed. On the drum 1 of the cartridge Pc, a developer image of cyan color corresponding to a cyan component image of a full-color image is formed. On the other hand, a feeding roller 18 of a feeding portion 16 is driven at predetermined control timing, and one sheet of recording medium S is separated and fed from a feeding cassette 17 in which the recording mediums S are contained. The feeding cassette 17 may be freely put in and taken out from the front side of the apparatus main body 100A (front loading). Reference symbol 17*a* denotes a handle portion provided on a front surface of the feeding cassette 17. The fed recording medium S is supplied onto the belt 11 from the front side at predetermined control timing by registration roller pair 19. The recording medium S fed onto the belt 11 is electrostatically attracted to the belt 11. Then, along with the rotation of the belt 11, the recording medium S is sequentially fed to respective transfer nip portions of the cartridge Pc, the cartridge Pm, the cartridge Py, and the cartridge Pk. To the transfer roller 12, there is applied a transfer bias from a power supply (not shown), which is a reverse polarity with respect to a charging polarity of the developer (charging polarity of toner), and has a predetermined potential. With this operation, four-color developer images of cyan color+magenta color+yellow color+black color are superposed and transferred on the recording medium S. With this operation, an unfixed full-color developer image is formed on the recording medium S. Then, the recording medium S is separated from the surface of the belt 11 to be introduced to a fixing portion 20. The fixing portion 20 fixes the developer image of a plurality of colors transferred onto the recording medium S. The fixing portion 20 includes a heating roller 20*a* that rotates and a pressure roller 20*b* which is brought into pressure-contact with the heating roller 20*a* to apply heat and pressure to the recording medium S. The recording medium S, on which the developer image is formed, is nipped and conveyed by the fixing roller pair 20*a* and 20*b* when passing through the fixing portion 20. Then, heat and pressure are applied to the recording medium S by the fixing roller pair 20*a* and 20*b*. With this operation, the developer image of the plurality of colors is fixed onto the surface of the recording medium S. Then, the recording medium S exits from the fixing portion 20, and is delivered from a delivery portion 24, through a convey path including a delivery roller pair 23, to a delivery tray 25 outside the apparatus main body 100A, as a full-color image formation product. Note that, in a case of a monochrome image forming mode, only the image formation using the cartridge Pk is performed.

(Cartridge Replacement System)

Figure 2B:
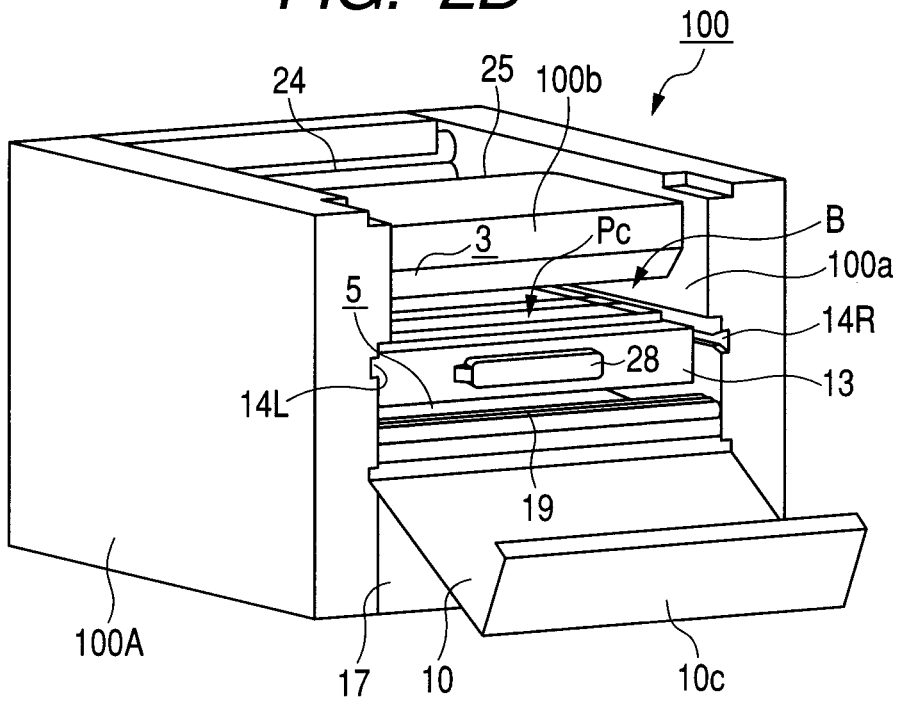
FIG. 2B is an appearance perspective view of the image forming apparatus under a door-opened state.
Figure 3A:
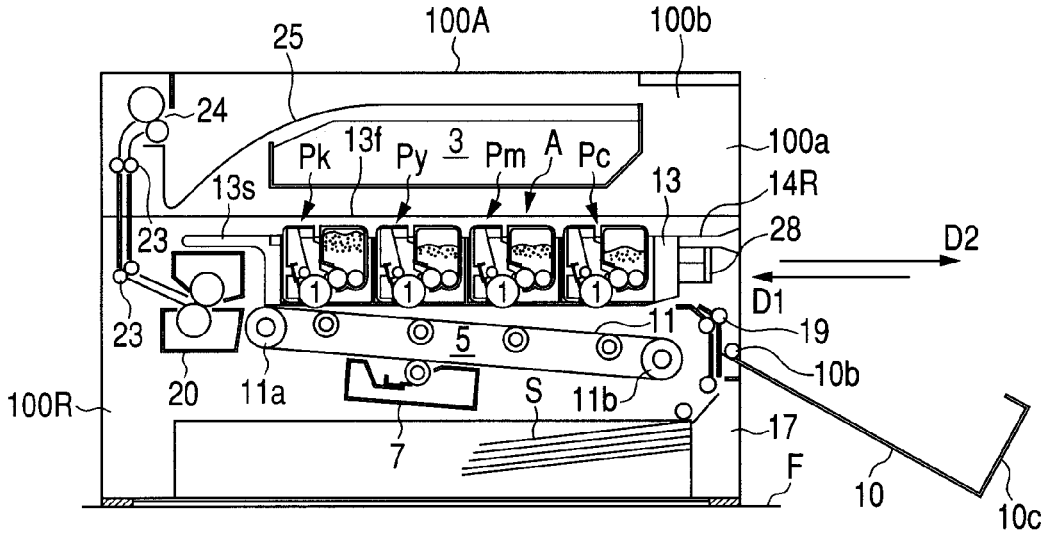
FIG. 3A is a vertical sectional right side view of the image forming apparatus under a door-opened state.

Replacements of the respective cartridges P may be performed by a user when the developer is consumed. In the image forming apparatus of this embodiment, the replacement of the cartridge is allowed to perform by front access by mounting the cartridges onto the drawer 13 as the cartridge supporting member which being a pullout frame member. When attaching and detaching the cartridges P with respect to the apparatus main body 100A, the attachment and detachment of the cartridges P are performed with respect to the drawer (the cartridge supporting member) 13 which is in a pullout state outside the apparatus main body 100A. Then, the drawer 13 supporting the cartridges P is pushed-into the apparatus main body 100A. With this operation, the cartridges P may be mounted to predetermined positions within the apparatus main body 100A. Thus, enhancement of the mounting and detaching operability of the cartridges P with respect to the apparatus main body 100A may be attained. In the front side of the apparatus main body 100A, a front opening portion (a first opening portion) 100*a* is provided. The opening portion 100*a* is an opening portion through which the cartridges are pushed-into the inside of the apparatus main body 100A, or, when the cartridges are pulled out from the apparatus main body 100A, the drawer 13 supporting the cartridges passes. Besides, on the front upper portion of the apparatus main body 100A, an upper opening portion (a second opening portion) 100*b* is provided continuously with the opening portion 100*a*. On the front side of the apparatus main body 100A, a rotatable door 10 is provided. The door 10 is an opening and closing member capable of assuming a closing position for closing the opening portion 100*a* and of assuming an open position for opening the opening portion 100*a*. In this embodiment, the door 10 is rotatable with respect to the apparatus main body 100A about a hinge portion 10*b* positioned at a lower side of the door. Specifically, the door 10 rotates about the hinge portion 10*b* as the center so as to be raised, whereby the opening portion 100*a* may be a closed (see FIG. 1A and FIG. 1B). Further, the door 10 rotates about the hinge portion 10*b* as the center so as to be tilted toward the front of the apparatus main body 100A, whereby the opening portion 100*a* may be an open state (see FIGS. 2B, 3A, and 3B). Reference symbol 10*a* denotes a finger hook portion formed in the front of the door 10. The top of the door 10 is folded inwardly at a substantially right angle as a top door portion 10*c* with respect to the opening portion 100*b*. If the door 10 moves to the closing position with respect to the opening portion 100*a*, the top door portion 10*c* also positions in a closing position with respect to the opening portion 100*b*, whereby the opening portion 100*b* is closed by the top door portion 10*c*. Besides, if the door 10 moves to the opening position for opening the opening portion 100*a*, the top door portion 10*c* also moves to the opening position for opening the opening portion 100*b*. With this operation, the opening portion 100*b* is opened. Specifically, the drawer 13 moves, while detachably supporting the plurality of cartridges P, between an inside position (mounting position) A positioned inside the apparatus main body 100A and a pullout position (outside position) B pulled out outside the apparatus main body 100A from the inside position A. The inside position A is, for example, a state illustrated in FIG. 1B and FIG. 3A. The pullout position B is, for example, a state illustrated in FIG. 3B, FIG. 4A, and FIG. 4B. The drawer 13 moves, under a state as illustrated in FIG. 2B and FIG. 3A in which the door 10 is opened, through the opening portion 100*a* in a fore-and-aft direction with respect to the apparatus main body 100A by being guided by a guide means described later. Specifically, the drawer 13 is provided so as to be linearly movable, with respect to the apparatus main body 100A, in a D1 direction (push-in direction: mounting direction) which is a substantially horizontal direction and in a D2 direction (pullout direction) which is reverse thereto. Then, the respective cartridges P are arranged in such a manner that the longitudinal directions thereof (an axial direction of drum 1, an axial direction of developing roller 40) are adjacent to each other in the movement directions of the drawer 13 (the same directions as directions indicated by the arrows D1 and D2), and are supported by the drawer 13. Specifically, the drawer 13 supports the plurality of cartridges P (Pk, Py, Pm, and Pc) under a state being arranged adjacently in one direction. As described above, the drawer 13 supports the plurality of cartridges P under a state in which the longitudinal direction thereof are arranged in an orthogonal direction (substantially orthogonal direction) with the D1 direction (D2 direction). Then, the drawer 13 is movable, under a state in which the door 10 is opened, between the inside position A for positioning the cartridges P inside the apparatus main body 100A and the pullout position (outside position) B pulled out from the inside position A, at which the respective cartridges are removable. Specifically, the drawer 13 moves between an inside position A and an outside position B while supporting the cartridges P. Here, the inside position A is a position at which the drawer 13 is positioned inside the apparatus main body 100A, and the cartridges P are positioned at an image forming position C at which the cartridges P form an image. Further, the outside position B is a position at which the drawer 13 is positioned outside the apparatus main body 100A, and the mounting and removal of the cartridges P with respect to the drawer 13 are performed. According to this embodiment, under a state in which the drawer 13 is positioned at the inside position A, the cartridges P perform the image formation. Under a state in which the drawer 13 is positioned at the pullout position B pulled out from the apparatus main body 100A, the cartridges P are removable with respect to the drawer 13. Here, the inside position A is positioned inside the apparatus main body 100A, and is the image forming position C at which the cartridges P form the above-mentioned image (FIGS. 1A and 1B and FIGS. 2A and 2B). The outside position B is positioned outside the apparatus main body 100A, and is a position at which the mounting and removal of the cartridges P with respect to the drawer 13 are performed.

Figure 5A:
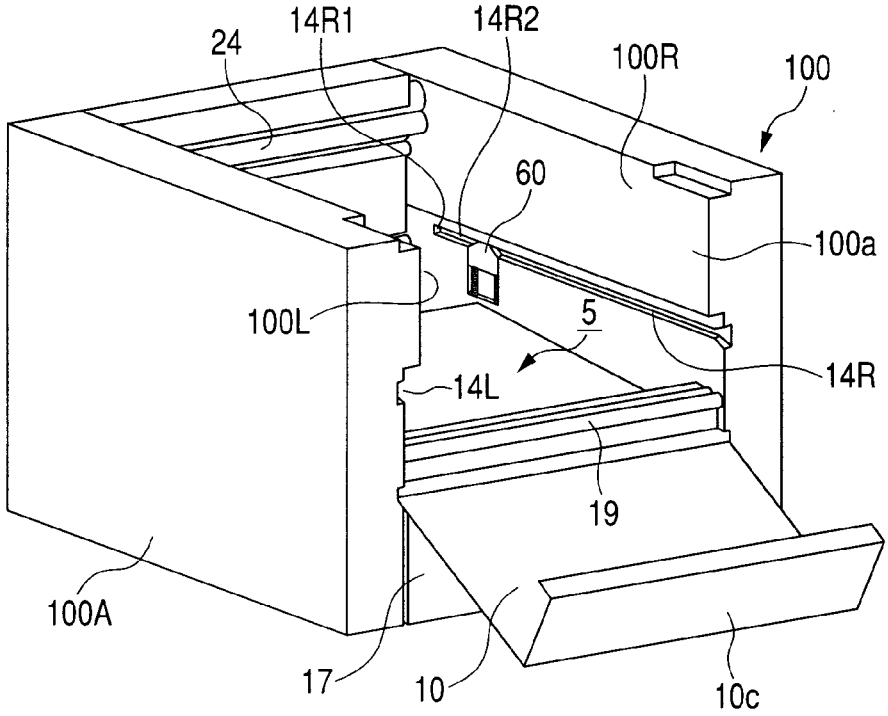
FIGS. 5A and 5B are views illustrating a drive output portion at an inside of an apparatus main body and the drawer mounting portion.
Figure 5B:
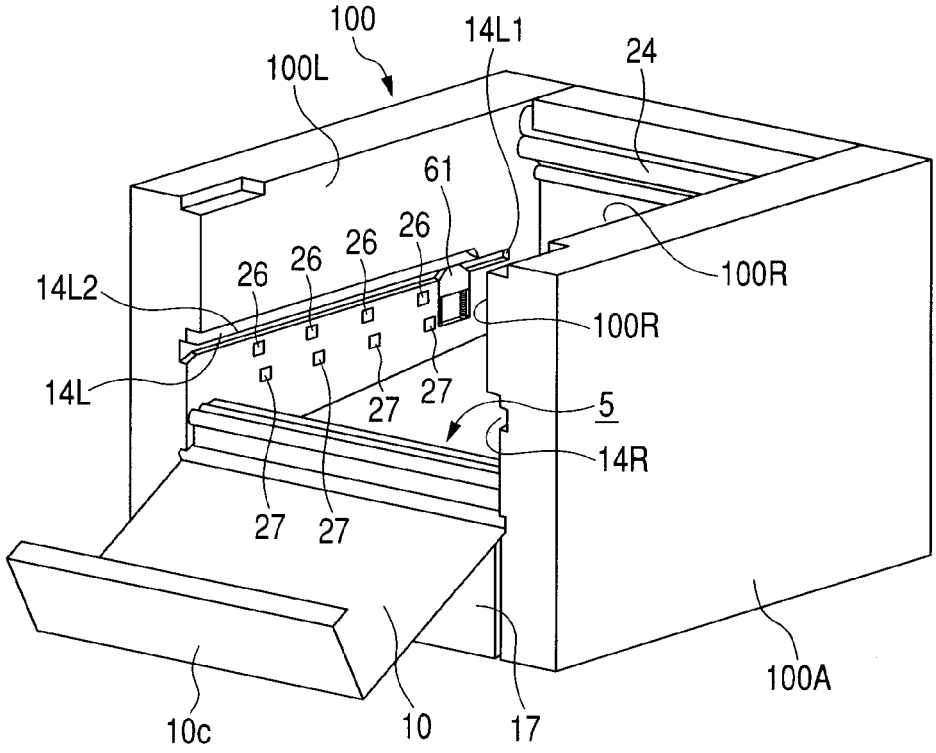

Under a state in which the door 10 is closed (FIG. 1A and FIG. 1B), the drawer 13 is positioned at the inside position A for positioning the cartridges P inside the apparatus main body 100A. Under this state, the inside position A is a position in which the drawer 13 is positioned inside the apparatus main body 100A than the opening portion 100*a*. According to this embodiment, the inside position A is a position in which the drawer 13 supports the respective cartridges P, and is a latent image forming position in which the electrostatic latent image may be formed on the drum 1 inside the apparatus main body 100A. Specifically, the respective cartridges P are positioned at their mounting positions with respect to the apparatus main body 100A. Then, the respective drums 1 are brought into contact with the belt 11, thereby being in a state in which the developer image may be transferred from the drums 1 onto the recording medium S which is conveyed by the belt 11. At the inside position A, the respective cartridges P are pressed by pressing members (not shown) to be fixed to predetermined positioning portions (not shown). In this state, with respect to drive input portions (coupling members 47 and 45: FIG. 7B) of the respective cartridges, drive output portions (drum coupling members 27 and developing roller coupling members 26: FIG. 5B) provided to the apparatus main body 100A are coupled. With respect to electrical contacts (not shown) of the respective cartridges, a power feeding system (not shown) on the apparatus main body 100A side is connected. The drawer 13 is positioned and fixed to the apparatus main body 100A by fixing means (not shown). In this state, the image forming apparatus 100 is allowed to carry out the image forming operation.

Figure 3B:
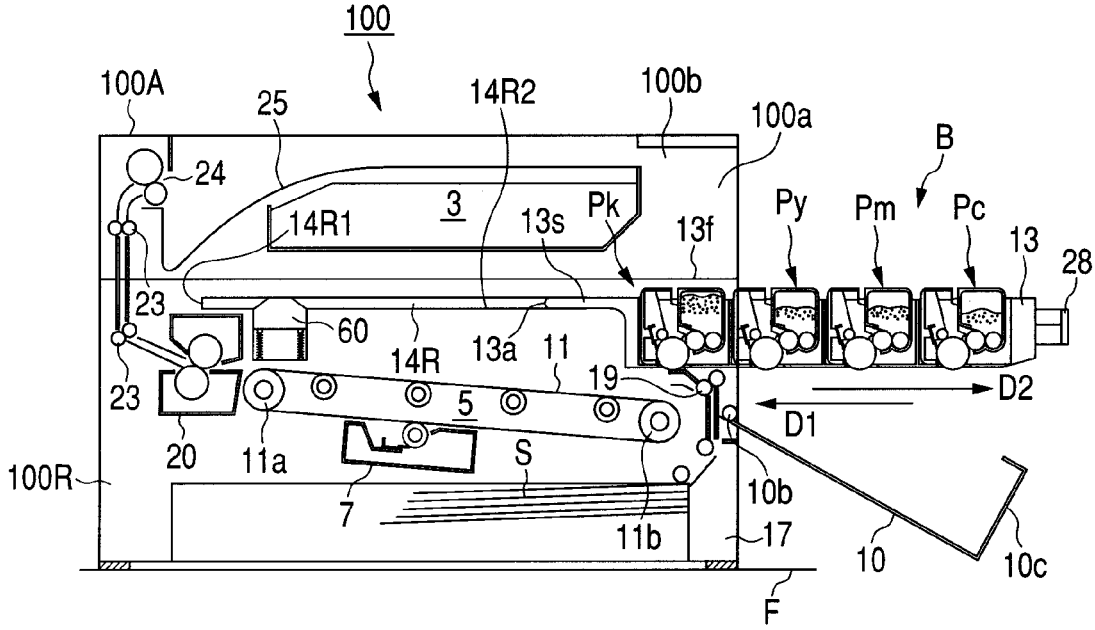
FIG. 3B is a vertical sectional right side view of the image forming apparatus in which a drawer is pulled-out to a pullout position.
Figure 4A:
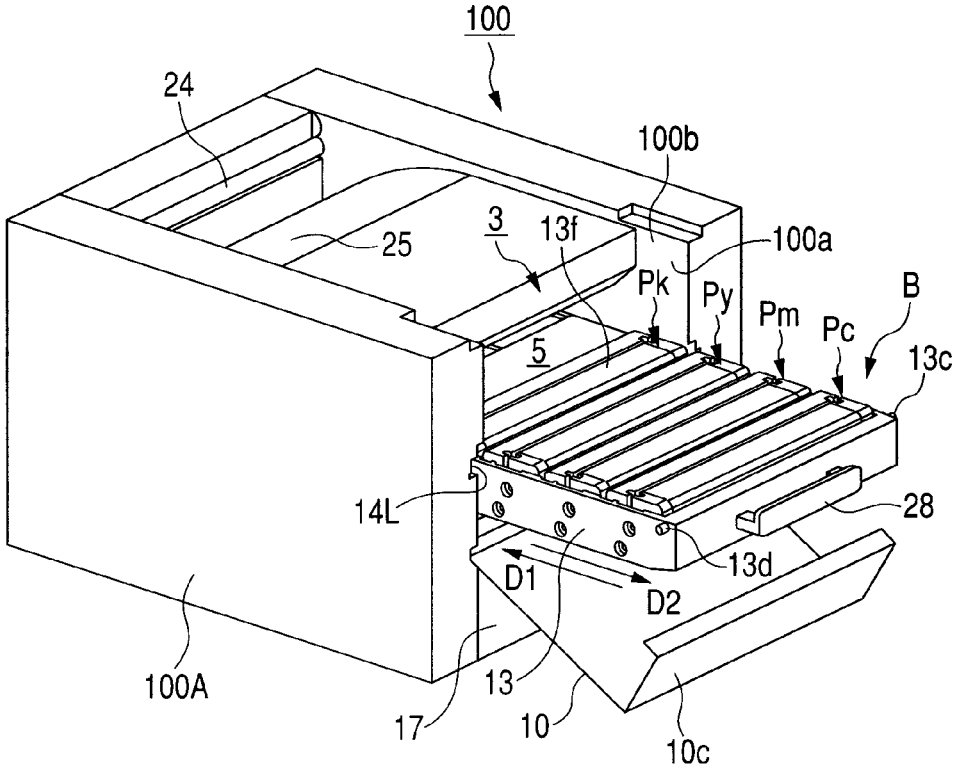
FIG. 4A is an appearance perspective view of the image forming apparatus in which the drawer is pulled-out to the pullout position.
Figure 4B:
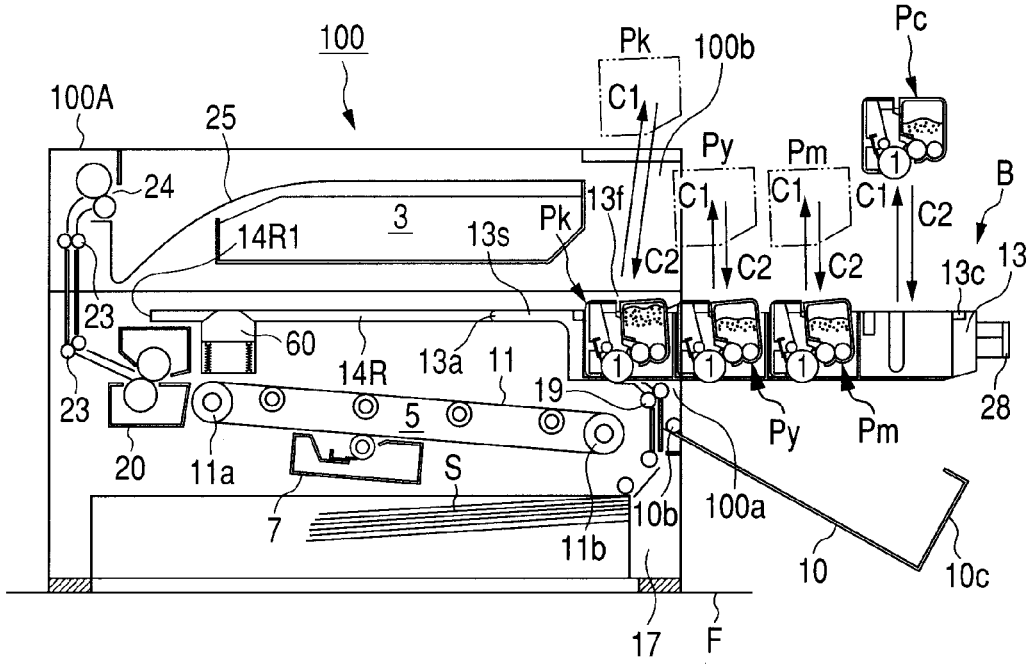
FIG. 4B is a view for illustrating a replacement procedure of a cartridge.

If the door 10 is opened (FIG. 2B and FIG. 3A), the opening portion 100*a* and the opening portion 100*b* of the apparatus main body 100A are opened. Then, at the opening portion 100*a*, a handle portion 28, which is provided to a front surface of a front frame of the drawer 13, is exposed. Further, with an interlocking mechanism (not shown), which associates with the opening movement of the door 10, a second roller 11*b* side of the electrostatic transfer belt unit 5 moves down to a predetermined position about a rotation center axis of a first roller 11*a* as a center. With this operation, the belt 11 is separated from the lower surface of the drum 1 of the respective cartridges P. Specifically, the contact of the belt 11 with respect to the drum 1 is released. Further, the coupling of the drive output portion on the apparatus main body 100A side with respect to the drive input portion of the respective cartridges P is released (drive release). Further, the pressing of the pressing member (not shown), with which the respective cartridges P are positioned and fixed, is released (pressing release). Further, the conduction of the power feeding system on the apparatus main body 100A side with respect to the electrical contacts of the respective cartridges P is released (power feeding release). Still further, the positioning and fixing of the drawer 13 with respect to the apparatus main body 100A by a positioning and fixing means is released. As described above, to the apparatus main body 100A, the opening portion (the first opening portion) 100*a* for allowing the drawer 13 to pass through is provided. Further, under a state in which the drawer 13 is positioned at the pullout position B, the opening portion (the second opening portion) 100*b* is provided so as to position above the cartridge Pk positioned most upstream in the pullout direction D2 of the pullout. Provision of the opening portion 100*b* allows the attachment and detachment of the cartridge Pk positioned on the deepest side in the apparatus main body 100A with respect to the drawer 13 to be carried more easily. Note that, if an opening area of the opening portion 100*a* is large, the attachment and detachment of the cartridge Pk with respect to the drawer 13 may be carried out without the opening portion 100*b*. However, provision of the opening portion 100*b* allows the attachment and detachment of the cartridge Pk with respect to the drawer 13 to be carried out further easier. The opening portions 100*a* and 100*b* are opened and closed using a common door 10. Then, the user grasps the handle portion 28 and slide-moves the drawer 13 horizontally in a forward direction, which being the pullout direction D2, with respect to the apparatus main body 100A. Then, the drawer 13 is pulled out sufficiently from the opening portion 100*a* to a predetermined pullout position B outside the apparatus main body 100A (FIG. 3B and FIG. 4A). Specifically, the drawer 13 is sufficiently pulled out to the predetermined position B, which is a position projected as much as possible from the inside to the outside of the apparatus main body 100A. If the drawer 13 is sufficiently pulled out to the predetermined pullout position B, the further pullout movement is blocked with a stopper member (not shown). During the pullout movement of the drawer 13, the drums 1 of the respective cartridges P and the belt 11 are separated. Thus, rubbing between the both is not caused. In this embodiment, in the pullout direction D2 of the drawer 13, the cartridge Pk positioned most upstream of the drawer 13 is positioned inside the apparatus main body 100A (FIG. 3B, FIG. 4A and FIG. 4B) at the pullout position B of the drawer 13. The other cartridges Py, Pm, and Pc are positioned outside the apparatus main body 100A. Then, the drawer 13 has a structure in which the individual cartridges P each may be ejected upward, and may be supported (mounted) by moving the respective cartridges downward. Therefore, the user lifts up a spent cartridge P to be replaced from the drawer 13 to remove the spent cartridge (upward as indicated by the arrow C1 of FIG. 4B). Then, a new cartridge P is dropped in the downward direction (downward as indicated by the arrow C2) with respect to the drawer 13 from the above, which being a substantially gravity direction. With this operation, the cartridge is supported in the drawer 13. The cartridges Py, Pm, and Pc positioned outside the apparatus main body 100A are removed by being lifted up with respect to the drawer 13 at the outside of the apparatus main body 100A, and are mounted by being fitted therein from the above. The cartridge Pk positioned inside the apparatus main body 100A may be removed from the drawer 13 under a state being positioned inside the apparatus main body 100A by allowing the cartridge Pk to pass through the opening portion 100*b*, and may be mounted onto the drawer 13 by being fitted therein from the above.

The user completes the replacement operation of the cartridge with respect to the drawer 13. After that, the user horizontally slide-moves the drawer 13 toward backward, with respect to the apparatus main body 100A, which is the push-in direction D1 being reverse to the pullout direction D2. Then, the user moves the drawer 13 from the pullout position B to the inside of the apparatus main body 100A by sufficiently pushing-in. When the drawer 13 is pushed-in sufficiently inside the apparatus main body 100A, positioned portions 13*a*1 and 13*b*1 (FIGS. 6A and 6B) abut on main body side positioning portions 14R1 and 14L1 (FIGS. 5A and 5B). With this, the further push-in movement of the drawer 13 is blocked (FIG. 2B and FIG. 3A). Then, the drawer 13 is positioned with respect to the apparatus main body 100A. According to this embodiment, through the reduction of the advancing speed of the drawer 13, which advances in a push-in direction D2, the relaxation of the impact which the drawer 13 receives from the apparatus main body 100A at the time when the drawer 13 is positioned with respect to the apparatus main body 100A is realized. In respect to this structure, a description will be provided later. During the push-in movement of the drawer 13, the drums 1 of the respective cartridges P and the belt 11 are separated, whereby the rubbing between the both is not caused. If the drawer 13 is sufficiently pushed-in inside the apparatus main body 100A, the door 10 is closed (FIG. 1A and FIG. 1B). With the closing operation of the door 10, the opening portion 100*a* and the opening portion 100*b* are closed. Further, with an interlocking mechanism (not shown) which associates with the mounting operation of the drawer 13 or the closing operation of the door 10, the drawer 13 is positioned and fixed with respect to the apparatus main body 100A by a position fixing means (not shown). Besides, the respective cartridges P are pressed by the pressing member (not shown) and are come into a state being positioned and fixed to predetermined positioning portions. Further, the drive output portion on the apparatus main body side is coupled with respect to the drive input portion of the respective cartridges P. Further, the conduction of the power feeding system on the apparatus main body side with respect to the electrical contacts of the respective cartridges P is established. Then, the roller 11*b* side moves up to a predetermined position about the rotation center axis of the roller 11*a* as a center. With this operation, the belt 11 becomes a contact state with respect to the lower surface of the drums 1 of the respective cartridges P. The contact state refers to a state in which the cartridges C are positioned at the image forming position C. According to this embodiment, in this state, the image forming apparatus 100 is allowed to carry out image forming operation.

As described above, the plurality of cartridges P enters inside the apparatus main body 100 together with the drawer 13 while being supported by the drawer 13. Accordingly, the user allows the drawer 13 to enter the inside of the apparatus main body 100A, and closes the door 10. With this operation, the plurality of cartridges P may be positively mounted with respect to the apparatus main body 100A. Therefore, compared to a structure of individually mounting the respective cartridges P within the apparatus main body 100A by the user, the mounting and detaching operability may be enhanced. As described above, the drawer 13 moves, while detachably supporting the plurality of cartridges P, between the inside position A positioned inside the apparatus main body 100A and the pullout position B pulled out from the inside position A to the outside of the apparatus main body 100A. Then, the drawer 13 supports the plurality of the cartridges P by arranging them in the drawer 13 so that the longitudinal directions of the cartridges P is orthogonal to the pullout direction D2 in which the drawer 13 is moved from the inside position A to the pullout position B.

(Drawer Mounting Portion of Apparatus Main Body)

Drawer mounting portions provided in the apparatus main body 100A will be described with reference to FIG. 5A and FIG. 5B. FIG. 5A is a perspective view of a driven side inside the apparatus main body 100A (left side), and FIG. 5B is a perspective view of a drive side (right side). A discharge portion 24, a scanner unit 3, the drawer 13, and the like are omitted therefrom. Inside a right side wall 100R and inside a left side wall 100L of a main frame constituting a skeletal structure of the apparatus main body 100A, guide members 14R and 14L are provided while opposing to each other. In this embodiment, the guide groove members 14R and 14L are provided substantially horizontally in the fore-and-aft direction, and a cross section, which is orthogonal to the substantially horizontal direction, has a rectangle shaped (C-shaped) groove portion. Specifically, the guide members 14R and 14L are grooves opposing with each other and having an opening 14R2, 14L2, respectively. The guide members 14R and 14L extend from the opening portion 100*a* toward a deep side of the apparatus main body 100A. With respect to the guide members 14R and 14L, the guided portion of the drawer 13, which are described later, are engaged. With this structure, the drawer 13 is mounted with respect to the apparatus main body 100A with the guide members and the guided portions being as guide means, so as to move in the arrow D1 direction (push-in direction) which is a substantially horizontal direction, and in the D2 direction (pullout direction) which is reverse thereto.

Specifically, the guided portions 13*a* and 13*c* are guided by the guide member 14R, and the guided portions 13*b* and 13*d* are guided by the guide member 14L, whereby the drawer 13 performs a slide movement. Specifically, the drawer 13 is guided by the above-mentioned guide means, thereby being capable of moving to the inside position A (mounting position) within the apparatus main body 100A. Further, provided at a back of the guide members 14R and 14L are positioning portions 14R1 and 14L1 for positioning the drawer 13 at the inside of the apparatus main body 100A. The position at which the below-mentioned positioned portions 13*a*1 and

13*b*1 of the drawer 13 (FIGS. 6A and 6B) are abutted on the positioning portions 14R1 and 14L1 is a mounting portion (inside position) of the drawer 13. As the material of the guide members 14R and 14L, a resin having slidability is employed in this embodiment taking a sliding property with the drawer 13 into consideration. In this embodiment, an ABS resin is used. However, taking rigidity of the drawer 13 into consideration, the production thereof may be made by using metal or the like. In the midway of the guide members 14R and 14L, force giving members 60 and 61 are provided, respectively. A description will be provided thereof later. Here, the above-mentioned substantially horizontal direction means substantially horizontal direction with respect to a mounting surface F of the image forming apparatus 100. Note that, the drawer 13 is not limited to the horizontal linear movement with respect to the above-mentioned mounting surface F, but may be configured, for example, to move linearly obliquely above or obliquely below with respect to the above-mentioned mounting surface F. In this embodiment, the left side wall 100L side of the main frame is a driving force transmitting side from the apparatus main body 100A to the cartridges P. Then, as illustrated in FIG. 5B, below the guide member 14L inside the left side wall of the respective cartridges P, the four drum coupling members (apparatus main body side drive output portion) 27 for transmitting driving forces to the drums 1 are arranged at the same intervals in the horizontal direction. Further, the four developing roller coupling members (apparatus main body side drive output portion) 26 for transmitting the drive force to the developing rollers 40, are arranged at given intervals in a horizontal direction. The above-mentioned coupling members 26 and 27 transmit the driving forces from the driving source (not shown) to the cartridges P. The coupling members 26 and 27 are in retreated states within the left side wall under the door opening state, and enter the cartridge P side in association with the door 10 closing operation.

(Drawer)

Figure 6A:
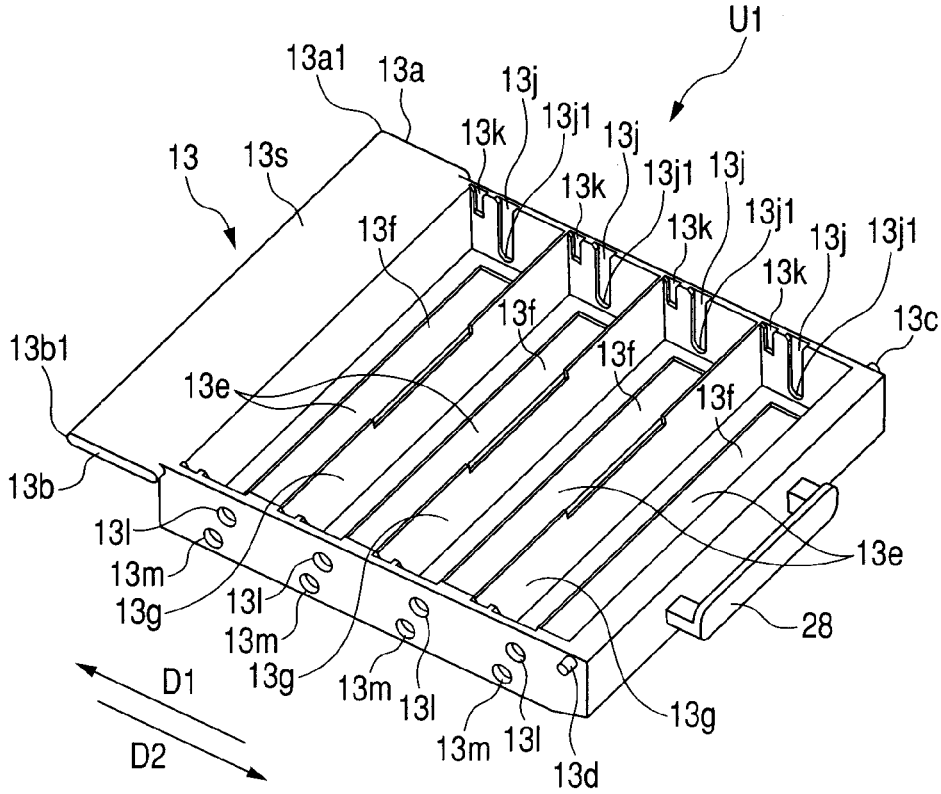
FIGS. 6A and 6B are views illustrating a structure of the drawer.
Figure 6B:
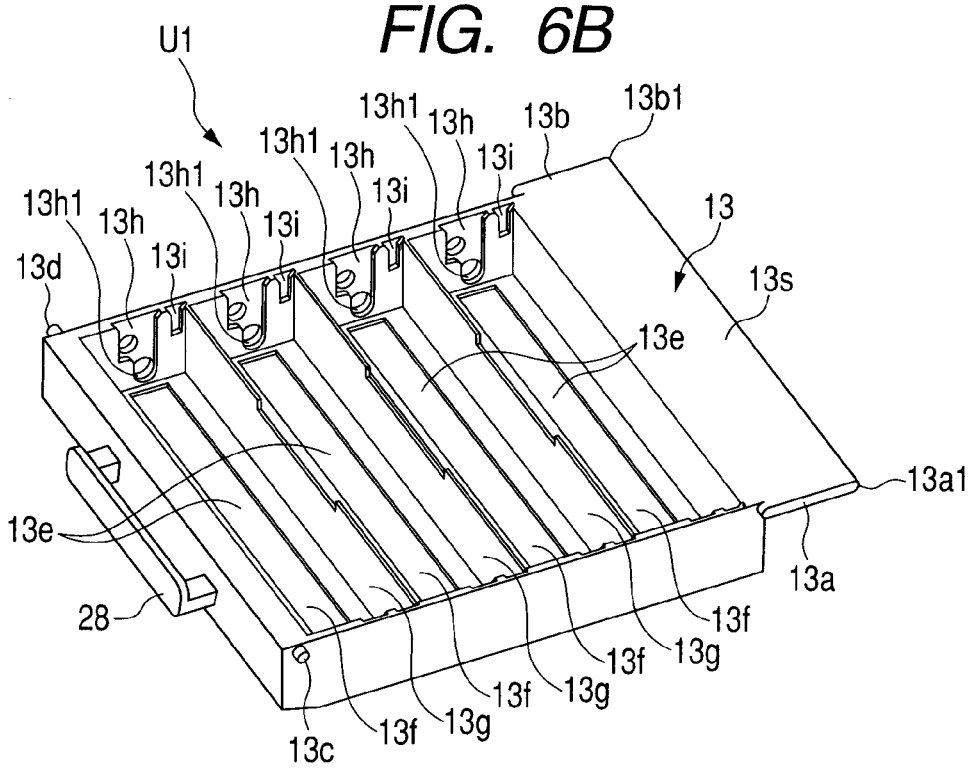

The drawer 13 will be described in detail with reference to FIG. 6A and FIG. 6B. FIG. 6A is a perspective view of the drawer 13, and the driving side (left side) thereof is viewed from obliquely upward, and FIG. 6B is a perspective view of the drawer 13, and the non-driving side (right side) is viewed from obliquely upward. The drawer 13 is a frame type member, and at the four corner portions thereof, the guided portions 13*a*, 13*b*, 13*c*, and 13*d*, which are guided by being engaged with the guide members 14R and 14L are provided. Note that, the guide members 14R and 14L are provided in the apparatus main body 100A. A guided portion (a first guided portion) 13*a* and a guided portion (a third guided portion) 13*c* are guided by being engaged with the right side guide member (a first main body side support member) 14R, respectively. Besides, the guided portion (a second guided portion) 13*b* and the guided portion (a fourth guided portion) 13*d* are guided by being engaged with the left side guide member (a second main body side support member) 14L, respectively. The guide members 14R and 14L are provided to the apparatus main body 100A so as to oppose to each other. The guided portions 13*a* (the first guided portion) and 13*b* (the second guided portion), which are provided upstream in the pullout direction D2, have a shape extending in the pullout direction. Therefore, the drawer 13 does not tilt with respect to the apparatus main body 100A at the pullout position B. In addition, the guided portion 13*a* has a shape projecting outwardly in a direction in which the guide portion 14R are provided so as to be guided by being engaged with the guide member 14R. Similarly, the guided portion 13*b* has a shape projecting outer side in a direction in which the guide member 14L is provided, so as to be engaged to the guide member 14L to be guided. As illustrated in FIG. 6A, the guided portion 13*a* and 13*b* are one end and the other end of the longitudinal direction of a guided member 13*s*, respectively. The guided member 13*s* is formed in a width direction (a direction orthogonal to the pullout direction D2) of the drawer 13, and is further projected from a mounting portion (cartridge support portion) 13*f*, which is positioned most upstream with respect to the pullout direction D2. As described above, this embodiment includes the guide member (the first main body side support member) 14R and the guide portion (the second main body side support member) 14L, which are provided in the apparatus main body 100A so as to oppose to each other, for movably supporting the drawer 13. Further, the drawer 13 includes the guided member 13*s*, which is provided most upstream of the pullout direction D2, and projecting over the entire width in the direction orthogonal to the pullout direction D2 and toward upstream in the pullout direction D2. Then, in the direction orthogonal to the pullout direction D2, the drawer 13 includes the guided portion (the first guided portion) 13*a* on one end side of the guided member 13*s*, and the guided portion (the second guided portion) 13*b* on the other end side. Then, the guide groove 14R movably supports the drawer 13 while supporting the guided portion 13*a*, and further, the guide member 14L movably supports the drawer 13 while supporting the guided portion 13*b*. Further, the guided portions 13*a* and 13*b* are each provided to one end and the other end of the guided member 13*s*, thereby being one piece. Therefore, strength (rigidity) of the guided portions 13*a* and 13*b* may be enhanced. Further, in addition to this, the guided member 13*s* is a flat plate having a substantially rectangle shape when being viewed from the above, and the guided portions 13*a* and 13*b* each are provided to one end and the other end in the longitudinal direction of the guided member 13*s*. Therefore, the guided portions 13*a* and 13*b* each extend along the pullout direction D2. With this structure, the guided portions 13*a* and 13*b* are supported positively with the guide members 14R and 14L and so as to enhance the strength (rigidity). At one end portions of the guided portions 13*a* and 13*b*, the positioned portions 13*a*1 and 13*b*1 are provided, which are abutted on the positioning portions 14R1 and 14L1 provided to the guide grooves 14R and 14L, to thereby perform the positioning of the position of the drawer 13 within the apparatus main body. The above-mentioned one end portions are end portions of the guided member 13*s* in the push-in direction D1, and the end portions of the drawer 13 in the push-in direction D1. Further, the guided portion 13*c* (the third guided portion) and 13*d* (the fourth guided portion) are a circular column shape (projecting portions), and are similarly, in a horizontal direction and a direction orthogonal to the pullout direction D2, a shape projecting outwardly. The positioned portion 13*a*1 abuts on the positioning portion 14R1, and the positioned portion 13*b*1 abuts on the positioning portion 14L1. With this structure, the drawer 13 is positioned at the inside position A. Then, the cartridges P is positioned at the image forming position C.

As described above, the drawer 13 includes, at one end side thereof, at the downstream side of the pullout direction D2, and the direction orthogonal to the pullout direction D2, the guided portion (the third guided portion) 13*c* projecting toward the orthogonal direction. Further, the drawer 13 includes, at the other end side thereof, the guided portion (the fourth guided portion) 13*d* projecting toward the orthogonal direction. Then, the guide groove 14R movably supports the drawer 13, while supporting the guided portion 13*c*, or, the guide member 14L movably supports the drawer 13, while supporting the guided portion 13*d*. Accordingly, in this embodiment, the guided portions 13*a* and 13*b* (the first guided portion and the second guided portion) upstream in the pullout direction D2, which require the strength (rigidity) is constructed into the guided portion 13*s* having a structure described above. Then, contrary to this, the guided portions 13*c* and 13*d* (the third guided portion and the fourth guided portion) downstream in the pullout direction D2, which does not require the strength (rigidity), is formed into the circular columnar shape (the projecting portion). With this structure, cost reduction thereof may be attained. The guided portions 13*a* to 13*d* are preferably formed of a material such as a resin having slidability, because of being moved while sliding with the guide members 14R and 14L. In this embodiment, an ABS resin is used. However, taking rigidity or the like of the drawer 13 into consideration, the production thereof may be made by using metal or the like.

Further, at the front surface of the front frame of the drawer 13, there is provided a handle portion 28 for manipulating the drawer 13 by the user. To the drawer 13, the four mounting portions 13*f* for mounting the cartridges P described later, are provided in a line in the fore-and-aft direction. Between the respective mounting portions 13*f*, there are provided partitioning plates 13*g* serving as guides (marks) for mounting the cartridges P. Below the respective mounting portions 13*f*, opening portions 13*e* are provided. Through the opening portion 13*e*, the drums 1 provided in the cartridges P are brought into contact with the belt 11. At the drive side ends of the respective mounting portions 13*f*, there are provided guide portions 13*h* and 13*i* for mounting the cartridges P into the drawer 13. Similarly, at the non-drive side ends of the respective mounting portions 13*f*, too, there are provided guide portions 13*j* and 13*k* for mounting the cartridges P into the drawer 13. Below the guide portions 13*h* and 13*j*, there are provided positioning portions 13*h*1 and 13*j*1 for positioning the cartridges P with respect to the drawer 13. Further, on the drive side of the drawer 13, there are provided opening portions 13*l* for allowing the coupling members 27 to enter, and opening portions 13*m* for allowing the coupling members 26 to enter. The coupling members 27 and 26 each enter the opening portions 13*m* and the opening portions 13*l* in association with an operation for closing the door 10. After that, the coupling members 27 and 26 are engaged with the coupling members of the cartridges P, to thereby transmit the driving forces to the cartridges P. As described above, the drawer 13 moves inside the apparatus main body 100A by moving the drawer 13 in the arrow D1 direction while mating the guided portions 13*a* to 13*d* provided to the drawer 13 with the guide members 14R and 14L. The drawer 13 is movable in the same direction with the above-mentioned one direction (the directions indicated by the arrows D1 and D2) in which the cartridges P are arranged. Specifically, the drawer 13 is movable in a direction orthogonal to the longitudinal direction of the cartridges P which are supported by the drawer 13.

(Cartridge)

Figure 7A:
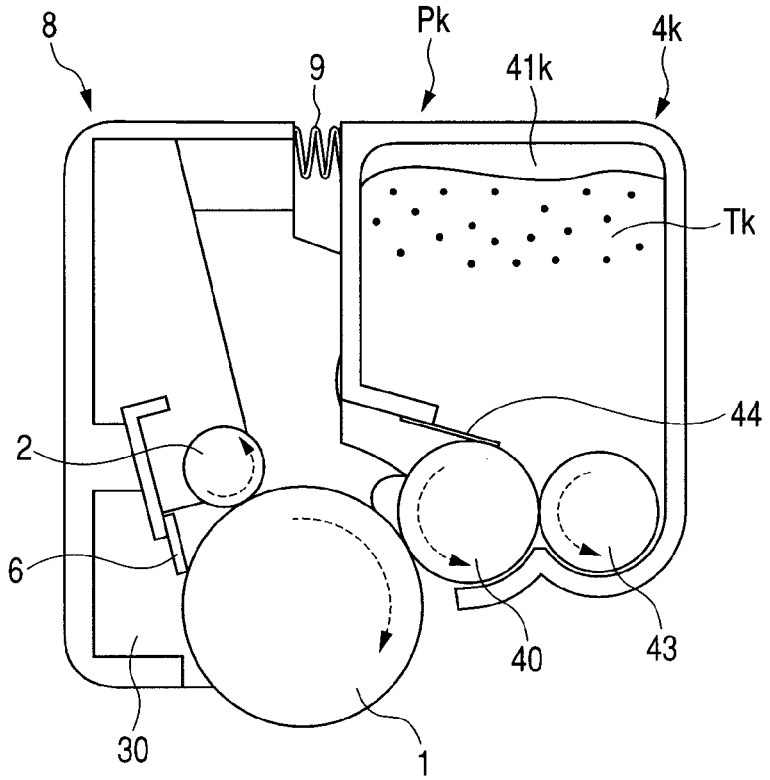
FIG. 7A is a schematic enlarged cross-sectional view of a black cartridge.
Figure 7B:
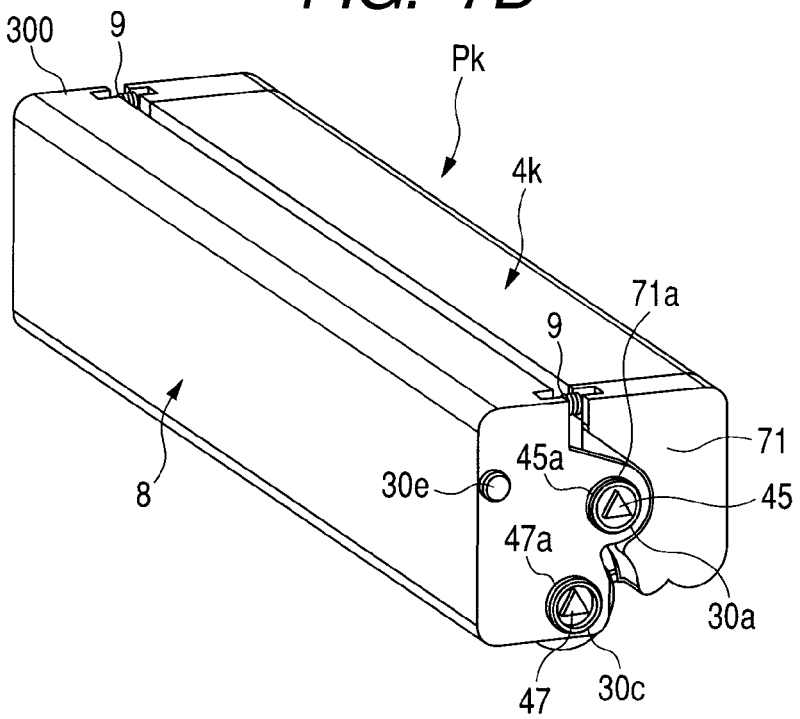
FIG. 7B is an appearance perspective view of the black cartridge viewed from a drive side.
Figure 8A:
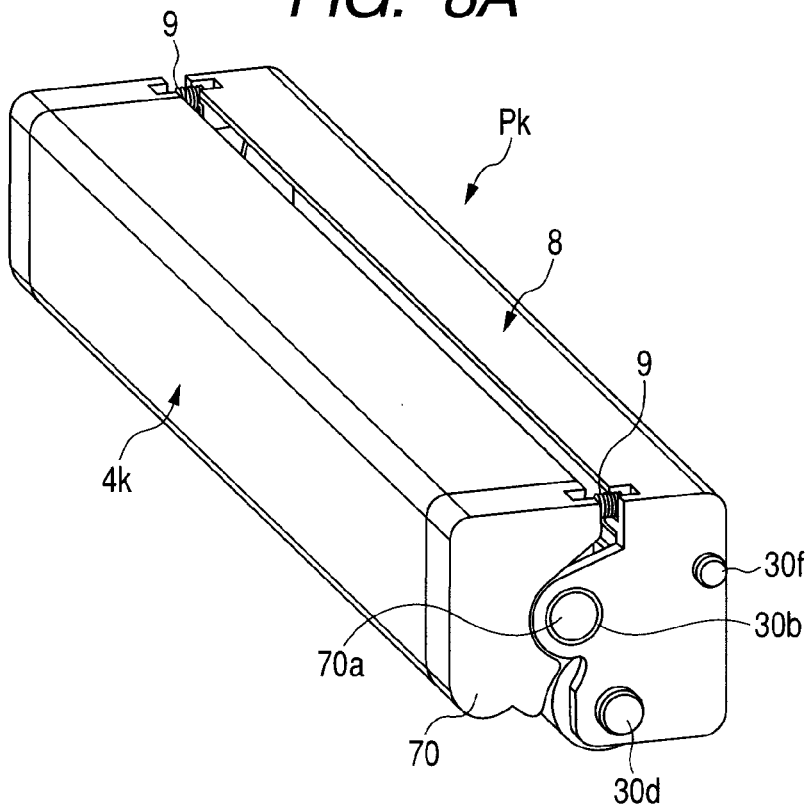
FIG. 8A is an appearance perspective view of the black cartridge viewed from a driven side.

With regard to the cartridges to be mounted (supported) on the drawer 13, a description will be provided with reference to FIGS. 7A, 7B, and 8A. FIG. 7A is an enlarged cross-sectional view of the cartridge P, and the description will be provided while taking as a representative a black cartridge Pk as an example. With regard to the other color cartridges Py, Pm, and Pc, the structures thereof are the same excepting that the amounts and colors of the contained developers are different from each other. FIG. 7B is a perspective view of the drive side of the cartridge Pk, which is viewed from obliquely upward. FIG. 8A is a perspective view of the non-drive side of the cartridge Pk, which is viewed from obliquely upward. The cartridge Pk is constructed by integrating the photosensitive unit 8 and the developing unit 4*k*. The photosensitive unit 8 includes the drum 1, the charging roller 2, the cleaning means 6, and a removed developer containing portion 30 for containing the developer removed by the cleaning means 6. Besides, the developing unit 4*k* includes a developing roller 40, a developer supply roller 43, a developing blade 44, and a developer containing portion 41*k* for containing the developer Tk to be used for image formation. The drum 1, the developing roller 40, and the supply roller 43 are rotatingly driven in a dotted arrow direction. The charging roller 2 is rotated in association with the rotation of the drum 1. To the charging roller 2, a predetermined charging bias is applied. To the developing roller 40, a predetermined developing bias is applied. The developer Tk within the developer containing portion 41*k* is fed into the supply roller 43. Then, with the developing blade 44, which is brought into pressure-contact with an outer periphery of the developer supply roller 43 and the developing roller 40, the developer Tk is applied to the outer periphery of the developing roller 40. Also, to the developer Tk, an electric field with a predetermined polarity is applied with the developing blade 44. Then, from the apparatus main body 100A side, a predetermined developing bias is applied to the developing roller 40. With this operation, an electrostatic latent image formed on the drum 1 is developed as the developer image. The developer image formed on the drum 1 is transferred onto the recording medium S, and thereafter, the developer remaining on the drum surface is removed by the cleaning means 6. The removed developer is received within the removed developer containing portion 30. If the developer Tk within the developer containing portion 41*k* is consumed, the operator replaces the cartridge Pk with new one. With this operation, the image formation may be carried out again. At the drive side end of the cartridge Pk, the coupling member 47 for receiving a driving force from the drum coupling members 27 on the apparatus main body side, is rotatably provided. Besides, the coupling member 45 for receiving a driving force from the developing roller coupling members 26 is rotatably provided. The coupling member 47 is provided to the drive side end of the drum 1. Then, the driving force received by the coupling member 47 from the apparatus main body 100A rotates the drum 1. Further, the driving force received by the coupling member is transmitted to the developing roller 40 and the developer supply roller 43 via an intermediate gear (not shown). The coupling member 45 is surrounded by a cylindrical rib 45*a*. The cylindrical rib 45*a* forms an engagement portion 71*a*. The engagement portion 71*a* is provided on a side cover 71 fixed to outside of the developer containing portion 41*k*. The coupling member 45 is rotatable with respect to the engagement portion 71*a*. Further, on an opposing side of the engagement portion 71*a*, an engagement portion 70*a* is provided. The engagement portion 70*a* is provided to the side cover 70 as well. The engagement portions 70*a* and 71*a* are provided on the developing unit 4*k* as well. Further, in the removed developer containing portion 30, hole portions 30*a* and 30*b* for supporting the engagement portions 71*a* and 70*a* are provided. The hole portions 30*a* and 30*b* provided in the removed developer containing portion 30 are engaged with the engagement portions 70*a* and 71*a* provided to the unit 4*k*. With this structure, the photosensitive unit 8 and the developing unit 4 are coupled to each other. Between the unit 8 and the unit 4, a spring (an urging member) 9 is provided by being compressed. With this stretching force (an elastic force) of the spring 9, the photosensitive unit 8 and the developing unit 4 are rotatably urged about the coupling portion as a center. With this structure, an abutment of the drum 1 and the developing roller 40 is secured. The coupling member 47 is surrounded with the cylindrical ribs 47*a*. The ribs 47*a* form a guided portion 30*c*. Further, on an opposing side of the longitudinal direction thereof, a cylindrical protrusion is projected to form a guided portion 30*d*. Further, above the guided portion 30*c*, a guided portion 30*e* is provided. Similarly, above the guided portion 30*d*, a guided portion 30*f* is provided. The respective guided portions 30*c*, 30*d*, 30*e*, and 30*f* have functions of mounting the cartridge Pk into the drawer 13, and of positioning the cartridge Pk within the drawer 13. Here, the photosensitive unit 8 may have a structure of containing at least the drum 1. In addition, the unit 8 may employ a structure of containing at least one of the charging roller 2, the drum cleaning means 6, and the removed developer containing portion 30 for receiving the developer removed by the cleaning means 6, and the drum 1.

(Cartridge Mounting (Supporting) of Drawer)

Figure 8B:
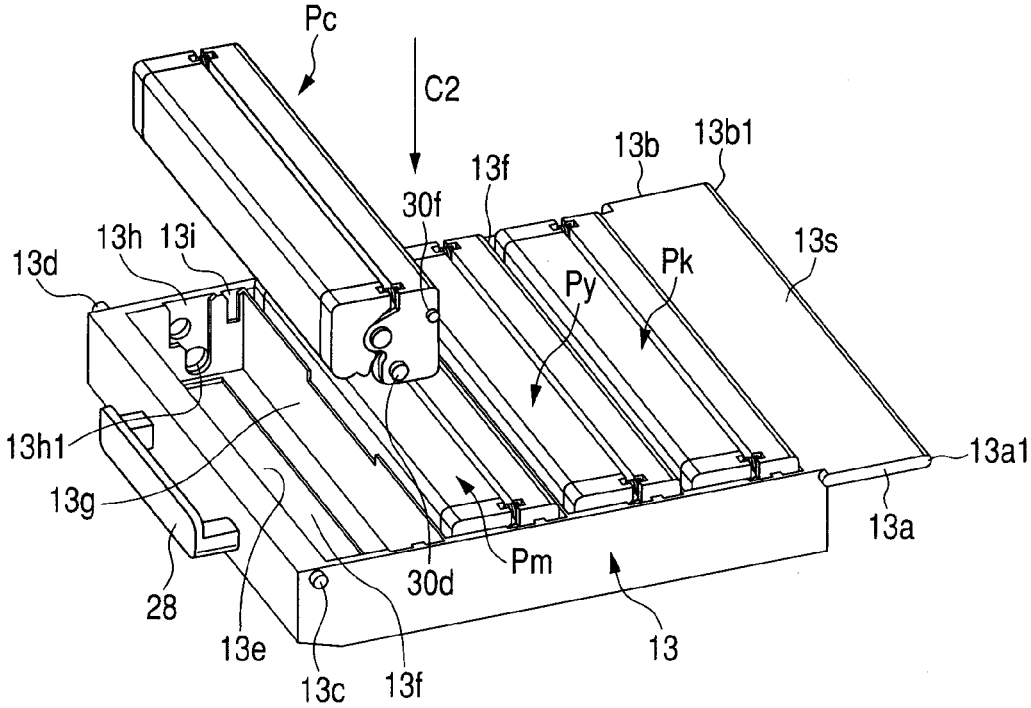
FIG. 8B is a perspective view illustrating a mounting state of a cartridge P to a drawer, which is viewed from obliquely upward on a driven side.
Figure 9A:
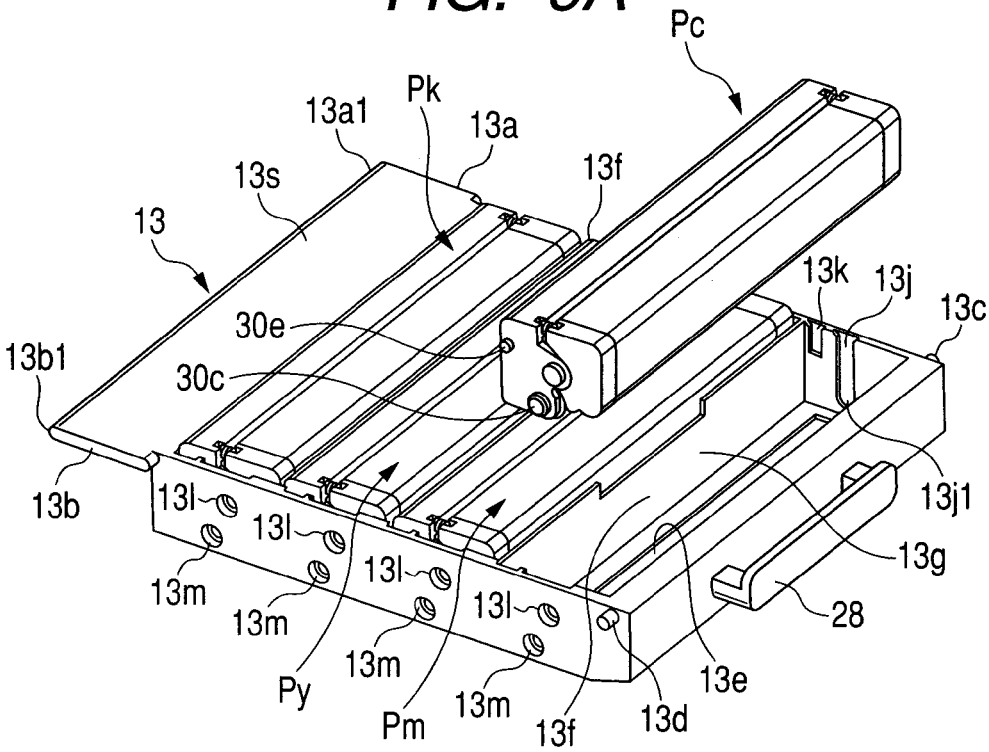
FIG. 9A is a perspective view of a state of FIG. 8B viewed from obliquely upward on the drive side.
Figure 9B:
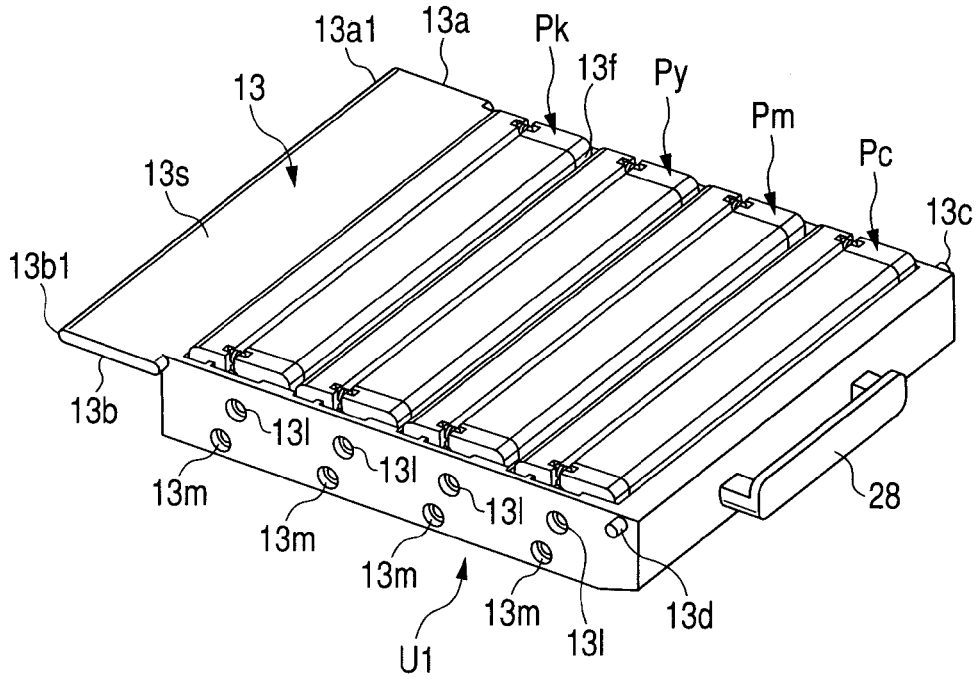
FIG. 9B is a perspective view illustrating a state in which all the cartridges are mounted onto the drawer, which is viewed from obliquely upward on the drive side.
Figure 10A:
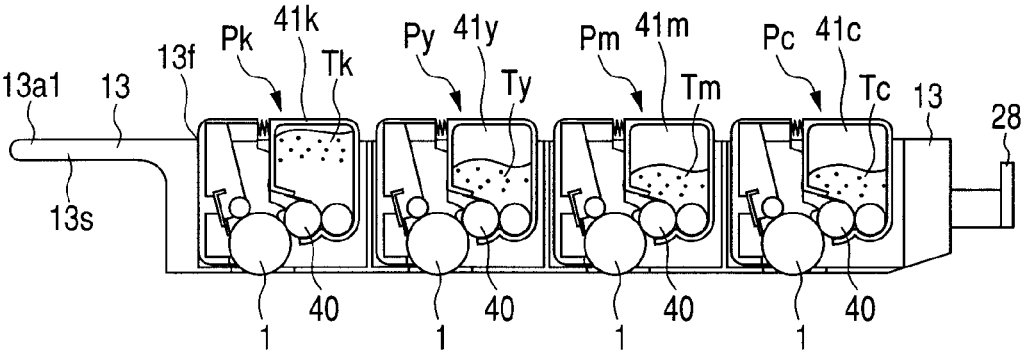
FIG. 10A is a vertical sectional right side view of a drawer under the state of FIG. 9B.

The mounting (supporting) of the respective cartridges P (Pk, Py, Pm, and Pc) to the drawer 13 is described with reference to FIGS. 8B to 10A. FIG. 8B is a diagram illustrating a mounting state of the cartridges P with respect to the drawer 13, and is a perspective view of the non-drive side viewed from obliquely upward. The apparatus main body 100A and the other components are omitted. FIG. 9A is a perspective view of the drive side viewed from obliquely upward, for illustrating a state of FIG. 8B. FIG. 9B is a perspective view of the drive side viewed from obliquely upward, for illustrating a state in which the mounting of all the cartridges to the drawer is completed. FIG. 10A is a vertical sectional right side view of the drawer in the state of FIG. 9B. The respective cartridges P are mounted to the corresponding mounting portions 13*f* provided to the drawer 13. The user moves the cartridges P downward in the arrow C2 direction, which is a substantially gravity direction, with respect to the corresponding mounting portions 13*f* of the drawer 13 for mounting. Further, the respective cartridges P are mounted to the corresponding mounting portions 13*f* of the drawer 13 in such a state being arranged adjacently in one direction (same direction with arrows D1 and D2 directions). The respective cartridges P are mounted so that the guided portion 30*c* and the guided portion 30*d* of the drive side end and the non-drive side end of the cartridges P correspond to the guide portions 13*h* and 13*j* of the corresponding mounting portions 13*f* of the drawer 13, respectively. Further, the mounting is carried out so that the guided portions 30*e* and 30*f* correspond to guides 13*i* and 13*k*, respectively. The cartridges P are mounted into the mounting portions 13*f* through the guides of the respective guide portions 13*h*, 13*i*, 13*j*, and 13*k*. The guided portion 30*c* of the cartridges P is abutted on the positioning portion 13*h*1 provided to the drawer 13. Further, the guided portion 30*d* is abutted on the positioning portion 13*j*1. Further, the guided portions 30*e* and 30*f* abut on the guide portions 13*i* and 13*k*. With this structure, the cartridges P are positioned within the drawer 13. In this embodiment, to the most upstream of the pullout direction (arrow D2) of the drawer 13, the black cartridge Pk containing the developer Tk of black color is mounted. Specifically, the drawer 13 supports the cartridge Pk at the most upstream side. As illustrated in FIG. 10A, the amount of the developer Tk contained in the developer containing portion 41*k* of the cartridge Pk is relatively larger than the amounts of the developers Ty, Tm, and Tc contained in the containing portions 41*y*, 41*m*, and 41*c* of the other cartridges Py, Pm, and Pc. This is because a use amount of the developer of black color is larger than the use amounts of the developers of the other colors. Therefore, the larger amount of the developer of black color is required to be contained. With such a structure, the user may be relieved of the troubles such as being necessary for frequently replacing the cartridge Pk, which is frequently used. Further, in this embodiment, capacities (developer containing capacity) of the developer containing portions 41 (41*k*, 41*y*, 41*m*, and 41*c*) containing the developer are all the same among the respective cartridges P (Pk, Py, Pm, and Pc). Specifically, the containing capacities of the developer containing portions of the plurality of cartridges are identical with each other. Among the plurality of cartridges having the same capacities, the black cartridge Pk only is increased in amount of the developer to be contained. Consequently, the containing portion 41 may be used commonly among the respective color cartridges P. Here, in this embodiment, components contained in the respective cartridges P (for example, drum 1, charging roller 2, cleaning means 6, cleaning means 6, developing roller 40, developer supply roller 43, a frame, etc.) are common. Besides, weights per unit volume of the developers are substantially the same, even if the colors of the developers are different. Accordingly, in this embodiment, the black cartridge Pk which contains the relatively larger amount of the developer than the other cartridges is heaviest compared to the other cartridges. As described above, the cartridge Pk is positioned within the apparatus main body 100A at the pullout position B of the drawer 13. Specifically, at the pullout position B of the drawer 13, the cartridge Pk is positioned at the inner side of the apparatus main body than a supporting part 100*c* of the apparatus main body 100A. On the other hand, on a top of the black cartridge Pk of the apparatus main body 100A, there is formed a top surface opening 100*b* for the black cartridge Pk for allowing the mounting and removal thereof. Specifically, under a state in which the cartridge Pk is positioned within the apparatus main body 100A, the cartridge Pk may be removed from the opening portion 100*b* upward. Here, the term "upward" means not only a vertical upward, but also includes the removal from the obliquely upward. Further, the opening portion 100*b* is a space formed upward the cartridge Pk, and designates the space which is an inner side of the apparatus main body than the supporting portion 100*c*. Specifically, under the state in which the cartridge Pk is positioned within the apparatus main body 100A, there is no problem as long as there is no space which interrupts the mounting and removal of the cartridge Pk upward. With the above-mentioned structure, without pulling out the drawer 13 so much, the mounting and removal of the cartridge Pk may be performed. Accordingly, as a moment generated in the drawer 13 may be made small, the drawer 13 is less likely to be inclined.

Figure 10B:
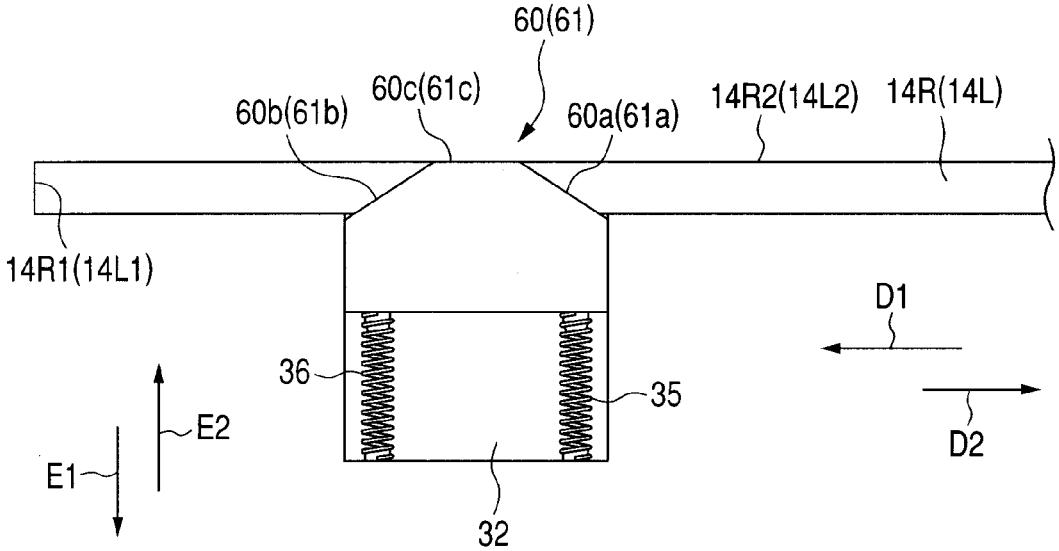
FIG. 10B is a view illustrating a force giving member.
Figure 14:
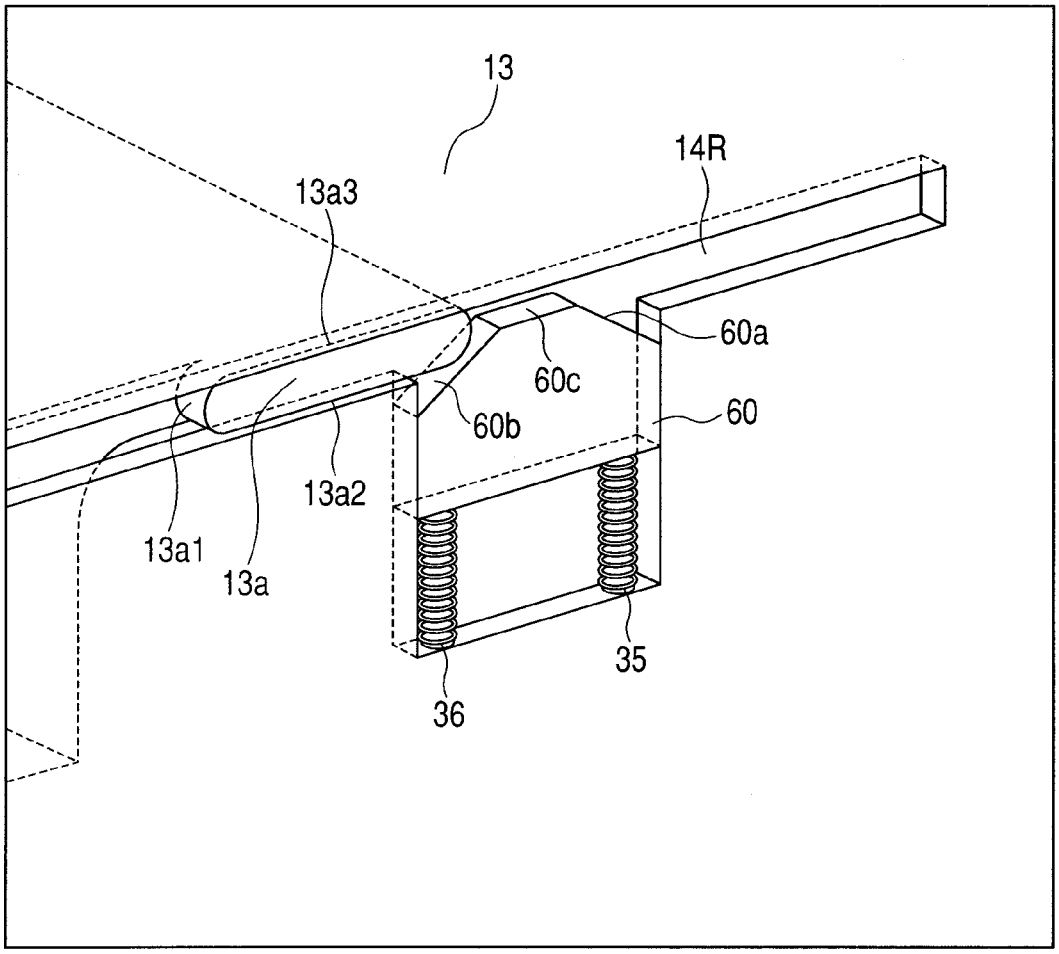
FIG. 14 is a perspective view of a force giving member.

(Force Giving Member): A description will be provided of force giving members 60 and 61 with reference to FIG. 10B and FIG. 14. FIG. 10B is a partial enlarged view of the force giving member 60 (FIG. 5A), which is provided to the right side guide member 14R. The force giving member 61 (FIG. 5B) provided to the left side guide member 14L has the same structure except for being provided so as to oppose to bilateral symmetry with the right side force giving member 60. Therefore, about the force giving members, a description will be provided of the right side force giving member 60 as a representative. As illustrated in FIG. 10B, with respect to the positioning portion 14R1 provided on one end side of the guide member 14R, a recess portion 32 is formed at the forward side (upstream side) in a mounting direction (arrow D1). Within the recess portion 32, a force giving member 60 is provided movable. At the upstream side and downstream side of the mounting direction of the force giving member 60, slopes are formed, and each of the slopes constitutes, a first force giving portion (resistance force giving portion) 60*a* (61*a*) and a second force giving portion (push-in force giving portion) 60*b*(61*b*) (details are described later). Between the force giving portions 60*a* and 60*b*, a flat surface portion 60*c* is provided. The force giving member 60 is constructed so as to be vertically movable within the recess portion 32 (arrows E1 and E2 direction). The force giving member 60 is made of a resin having slidability so as to be movable within the recess portion 32. In this embodiment, a polyacetal resin is used. The force giving member 60 is urged by springs (elastic member) 35 and 36 in the guide member 14R direction. The force giving member 60 urged by the elastic force of the springs 35 and 36 is positioned under a state of being urged to the top surface portion 14R2 of the guide member 14R. There is provided a cove (not shown) at a forward side in a vertical direction of a paper surface of the force giving member 60. With the above-mentioned cover, a force giving member 60 is adapted so as not to be removed, and the above-mentioned cover also serves as a guide portion of the drawer 13.

(Action of Force Giving Member 60 on Drawer 13): Referring to FIGS. 11A to 11E and FIG. 14, a description will be provided of a relationship between the drawer 13 and the force giving member 60 until the drawer 13 is positioned to the inside position A. Here, a description will be provided in order from upstream side of the drawer 13 in the mounting direction D1. For simplification of the description, as for the drawer 13, the guided portion 13*a* only is described, and the other structures are omitted. Note that, as the relationship between the force giving member 61 and the drawer 13 on opposite side is the same, the description thereof is omitted.

Figure 11A:
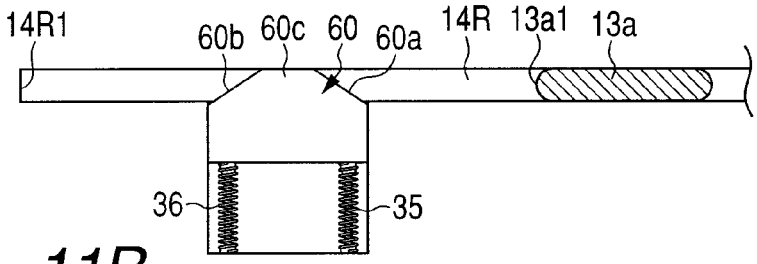
FIGS. 11A, 11B, 11C, 11D, and 11E are diagrams illustrating operating processes between the force giving member and the drawer.

FIG. 11A is a diagram at the time when the guided portion 13*a* is positioned at the forward side than the force giving member 60. The drawer 13 moves from the pullout position B as illustrated in FIG. 3B toward the inside position A (FIG. 3A) along the mounting direction of the arrow D1 direction. The user mounts the drawer 13 in the same direction with the mounting direction D1. At this time point, the force F1 in the opposite direction D2 of the drawer 13 is a friction force acting on between the guide member 14R and the guided portion 13*a*. The friction force is sufficiently smaller than a force which is given by the force giving member 60 described later.

Figure 11B:
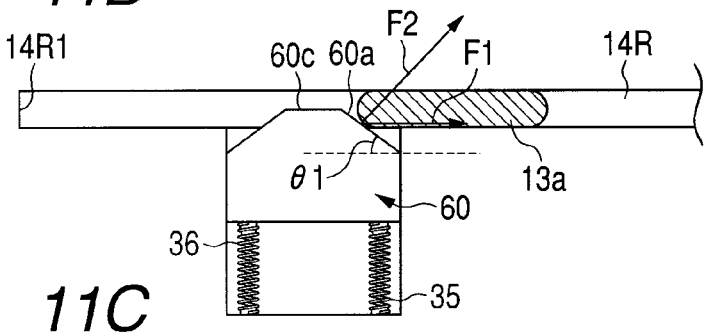

FIG. 11B is a diagram at the time when the guided portion 13*a* is abutted on the first force giving portion 60*a* of the force giving member 60. When the drawer 13 is further mounted in the mounting direction D1, the guided portion 13*a* abuts on the first force giving portion 60*a* of the force giving member 60. As the guided portion 13*a* is abutted on the slope of the first force giving portion 60*a*, resulting in being given the force F1 in the opposite direction D2 of the mounting direction. The force F1 acts on the drawer 13 in the direction opposite to the force acting toward the mounting direction. With this structure, the impact on mounting may be suppressed. The force giving member 60 moves downward by being pushed by the guided portion 13*a*. Here, a description will be provided of the force F1 acting on the guided portion 13*a*. Spring constants of the springs 35 and 36 urging the force giving member 60 are defined as k1 and k2, respectively, contraction amounts of the springs 35 and 36 from a free length are defined as $\Delta x1$ and $\Delta x2$, and an angle of the first force giving portion 60*a* with respect to a horizontal line is defined as $\theta 1$. In this case, the following Equation 1 and Equation 2 are established. $F1=F2\cdot\cos\theta 1$ . . . Equation 1, $F2=k1\cdot\Delta x1+k2\cdot\Delta x2$ . . . Equation 2. In addition, if the relation between a moving amount $\Delta y$ in the arrow D1 direction of the drawer 13 and the contraction amounts x1 and x2 of the springs 35 and 36 is expressed by an equation, the following Equation 3 and Equation 4 are established. The springs 35 and 36 are defined as the same structure. $\Delta x1=\Delta y\cdot\tan\theta 1$ . . . Equation 3, $\Delta x2=\Delta y\cdot\tan\theta 1$ . . . Equation 4. From the above-mentioned Equation 1 and Equation 2, $F1=(k1\cdot\Delta x1+k2\cdot\Delta x2)\cdot\cos\theta 1=\sin\theta 1\cdot(k1+k2)\cdot\Delta y$ . . . Equation 5 is established. From Equation 5, the moving amount $\Delta y$ of the drawer 13 in the mounting direction D1 and the force F1 given from the force giving member 60 to the drawer 13 are proportional relationship. Specifically, the force F1 is gradually increased along with the movement of the drawer in the mounting direction D1 by a ratio of $z1=\sin\theta 1\cdot(k1+k2)$. However, the weight of the force giving member 60 and the friction force between the force giving member 60 and the guided portion 13*a* are sufficiently small compared to the urging forces of the springs 35 and 36, thereby being ignored in the calculation. As in the state illustrated in FIG. 11B, the drawer 13 is not yet positioned at the mounting position A. However, as the force F1 acts on against the mounting direction, and hence depending on the user, there is a fear of stopping the mounting of the drawer 13 into the apparatus main body in the midway. To prevent such case, there is employed a structure in which under the above-mentioned state, the door 10 is abutted on the drawer 13, thereby being not able to be closed. Besides, there may also employ such another structure that the position of the drawer 13 is detected, to thereby prevent from entering into the image formation operation, or the like. In any event, under a state in which the drawer 13 is given, by the force giving members 60 and 61, a force which is opposite to the mounting direction, a control circuit portion 200 is configured to prevent the image forming apparatus from starting the image forming operation.

Figure 11C:
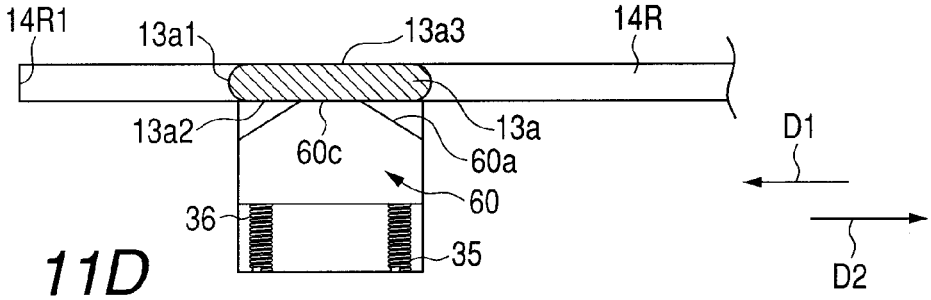

FIG. 11C is a diagram at the time when the guided portion 13*a* is abutting on the flat surface portion 60*c*. When the drawer 13 is further mounted in the mounting direction D1, a lower surface 13*a*2 of the guided portion 13*a* is pushed upward of the flat surface portion 60*c* of the force giving member 60. Then, the drawer 13 moves under a state in which the upper surface 13*a*3 is abutted on the guide member 14R. At this time, the friction force between the guide member 14R and the guided portion 13*a* acts on the drawer 13. In this case, even if the movement amount $\Delta y$ of the drawer 13 varies, the force F1 does not vary. Note that, the omission of the flat surface portion 60*c* does not cause a matter of inconvenience. However, with employment of the flat surface portion 60*c*, the drawer 13 may move smoothly.

Figure 11D:
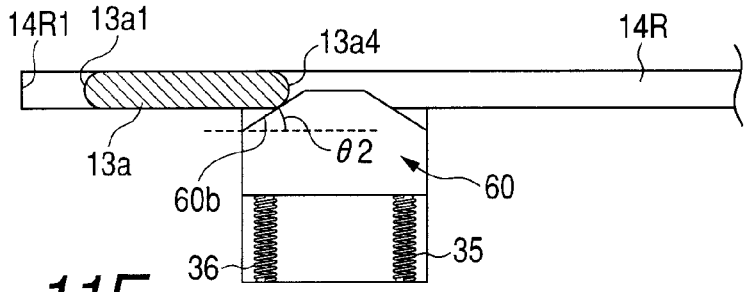

FIG. 11D is a diagram at the time when the guided portion 13*a* is abutted on the force giving portion 60*b*. When the drawer 13 is further mounted therein, the force giving portion 60*b* moves upward while abutting on a rear end portion 13*a*4 of the guided portion 13*a*. To the drawer 13, by the force giving portion 60*b*, the force F1 is given in a minus direction, namely, on the mounting direction D1 side. Accordingly, when the user mounts the drawer 13 at the mounting position, the user may receive an assist by a force giving member 60. With this structure, the mounting of the drawer 13 may be facilitated. Alternatively, there was employed a structure in which the force F1 in the mounting direction is given after the force F1 in an opposite direction D2 is acted on. With this structure, the user may be given a sense of mounting of the drawer. Accordingly, the user may recognize that the drawer 13 is properly mounted.

Figure 11E:
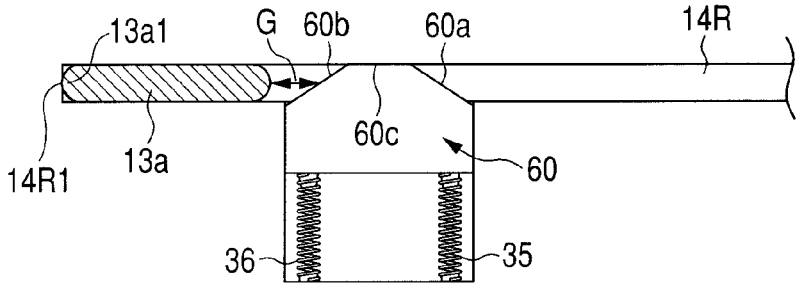

FIG. 11E illustrates a state in which the positioned portion 13*a*1 provided to the guided portion 13*a* is abutting on the positioning portion 14R1 provided to the guide member 14R. The drawer 13 passes through the force giving member 60, and then positioned at the inside position (mounting position) A of FIG. 11E, while abutting the positioned portion 13*a*1 to the positioning portion 14R1. At this time, the guided portion 13*a* is already not given the force opposite to the mounting direction D1 by the force giving member 60. Accordingly, there may prevent the drawer 13 from returning again toward the drawer direction D2. Note that, the force giving member 60 is urged upward by the elastic forces of the springs 35 and 36. With this structure, under a state in which the drawer 13 does not pass through the force giving member 60, the force giving member 60 abuts on the top surface of the guide member 14R. In this state, the force giving member 60 is a standby state (FIG. 11E). Note that, in the inside position A, the drawer 13 is spaced apart from the second force giving portion (push-in force giving portion) 60*b* (61*b*) (state illustrated in FIG. 11E). According to this embodiment, under the state in which the drawer 13 is positioned at the inside position A, an interval G (FIG. 11E) between the guided portion 13*a* and the second force giving portion 60*b* is set to about 5 mm to 50 mm. Like this, the guided portion 13*a* and the second force giving portion 60*b* are spaced apart from each other, and hence an approach running may be obtained when the user pull out the drawer 13. Accordingly, the pull-out operability of the drawer 13 may be enhanced. Note that, when the drawer is pulled out, operations, which are opposite to that illustrated in FIGS. 11A to 11E, are performed. Specifically, first, the guided portion 13*a* is brought into contact with the second force giving portion 60*b* to press down the force giving member 60. Next, the guided portion 13*a* passes through the flat surface portion 60*c*, and after that the guided portion 13*a* (drawer 13) receives the force in the pulling out direction from the first force giving portion 60*a*. With this, the drawer receives the assist when pulling out the drawer 13.

Figure 12A:
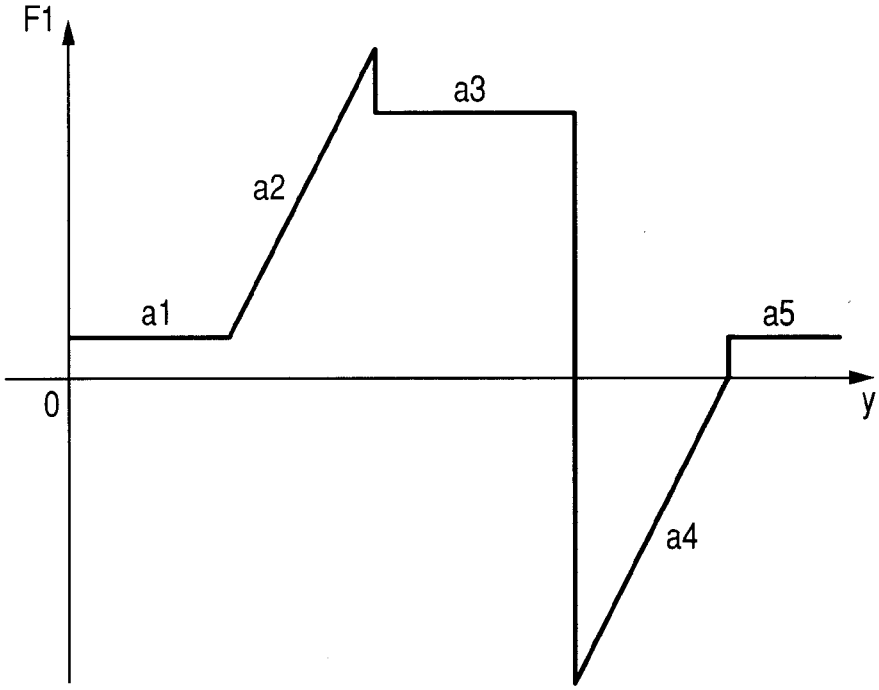
FIGS. 12A and 12B are graphs illustrating a relationship between a movement amount of the drawer and a force to be given to the drawer.

Next, in FIG. 12A, the movement amount y of the drawer 13 in the mounting direction D1, and the force F1 which acts on the opposite direction of the mounting direction D1 of the drawer 13 are made into a graph. An abscissa represents the moving amount y of the drawer 13, and an ordinate represents the force F1. In the regional, as illustrated in FIG. 11A, the friction force between the guide member 14R and the guided portion 13*a* acts on. In the region a2, as illustrated in FIG. 11B, the guided portion 13*a* is given a force from the force giving member 60. As described above, the force F1 is gradually increase by an inclined angle of sin θ1·(k1+k2). In this embodiment, an angle θ1 with respect to a horizontal line of the force giving portion 60*a* is set to 30°, the spring constants k1 and k2 of the springs 35 and 36 are set about 35 g/mm, respectively, and finally, in the region a2, there was employed such a structure that the force F1 of about 500 g in maximum was acted on. After that, in the region a3, as illustrated in FIG. 11C, the guided portion 13*a* receives the force F1 of the friction force. In the region a4, as illustrate in FIG. 11D, the guided portion 13*a* is given a force from the force giving portion 60*b*. Therefore, the drawer 13 is given a force in the mounting direction D1. The force F1 gradually increases in accordance with the spring constants of the spring 35 and 36, and with an angle of the force giving portion 60*b*. In this embodiment, the angle θ2 with respect to the horizontal line of the force giving portion 6*b* is set to 30°. In the region a5, the force giving from the force giving member 60*b* is ended, and the friction force between the guide member 14R and the guided portion 13*a* acts on again. Finally, the drawer 13 is positioned at the inside position A. Giving an example, it was estimated that the weight of the cartridge P is about 600 g, and a total amount in a state in which the weight of the drawer 13 supporting four colors of (four pieces) of the cartridges P is about 3,000 g. In this case, the spring forces of the springs 35 and 36 were set to 500 g to 2,000 g. The meanings of the values are as follows: the minimum value of a load which is capable of absorbing the impact of the drawer 13 is about 500 g, and the maximum value of the load which is felt as being a heavy resistance is about 2,000 g when the user moves the drawer 13.

Figure 12B:
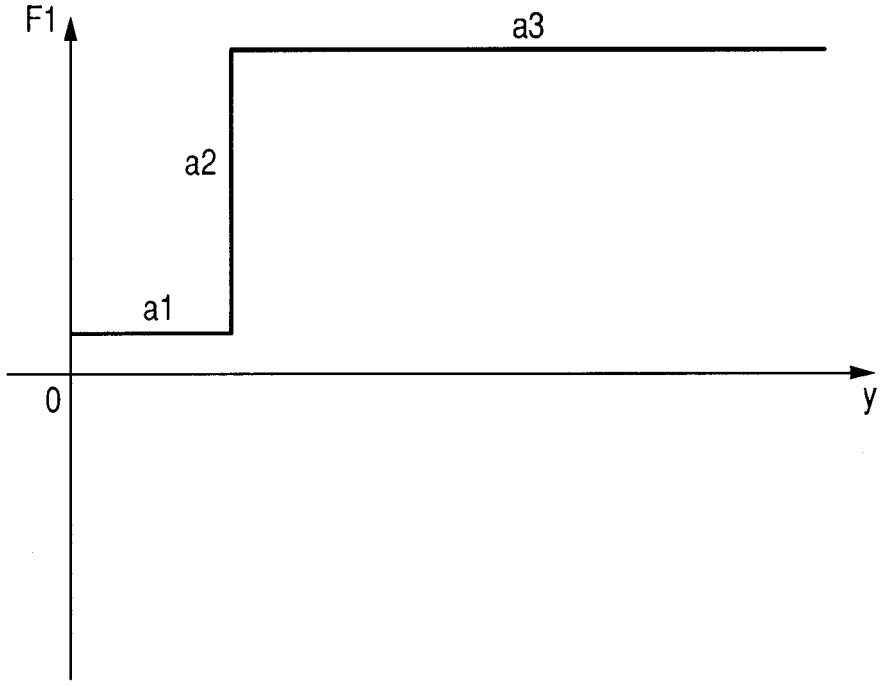

Next, in FIG. 12B, for a case where, as a braking force, the friction force is used without using a resistance force giving member of the present invention, the relation between the moving amount y of the drawer in the mounting direction and the force F1 acting on a direction opposite to the mounting direction D1 of the drawer were made into a graph. The regional of FIG. 12B is the same with the regional of this embodiment illustrated in FIG. 12A. However, in the region a2 succeeding thereto, the force F1 rapidly acts on the drawer. Accordingly, it is thought that the same rapid braking force may be generated to the cartridges mounted within the drawer.

Contrary to this, according to the structure of this embodiment, when mounting the drawer 13 in which the cartridges P are mounted into the apparatus main body 100A, the impact on mounting may be gradually suppressed by the force giving member 60. Specifically, there was employed a structure in which the braking force to be given to the drawer 13 is increased, along with the movement in the mounting direction D1, by a ratio of an inclination of sin θ1·(k1+k2). Accordingly, the braking force to be applied to the cartridges P is also given gradually. Therefore, the rapid impact to be applied to the drawer 13 and the cartridges P may be suppressed. Note that, it is preferred that the inclination of z1=sin θ1·(k1+k2) of the force given to the guided portion 13*a* by the force giving member 60 be set to a proper amount in accordance with each of the embodiments. Specifically, the followings are taken into a consideration: the drawer 13 and a supporting (accommodating) state of the cartridges P supported therein; the weights of the drawer 13 and the cartridges; and the materials of the respective components. Then, it is preferred that the inclination of the force be arbitrary selected through the adjustment of the spring constants (k1 and k2) with respect to the horizon line. With employing such a scheme, it is possible to provide a proper inclination with respect to force to be given to the drawer 13.

Further, in this embodiment, as illustrated in FIGS. 5A and 5B, the force giving members 60 and 61 are provided on both sides of the apparatus main body in a direction perpendicular to the mounting direction D1 of the drawer 13. Specifically, the force giving members 60 and 61 are provided on one end side and the other end side of the direction perpendicular to the movement direction of the drawer 13. Accordingly, compared to a case of being provided with the force giving member on one side, when the force is given to the drawer 13, the drawer 13 is less likely to be inclined with respect to the mounting direction. The force giving members 60 and 61 are provided at the substantially same positions in the mounting direction D1. The force giving members 60 and 61 are provided, in the mounting direction D1, at the forward side of the positioning portions 14R1 and 14L1 provided to the guide grooves 14R and 14L, at which the positioned portions 13*a*1 and 13*b*1 of the drawer 13 are positioned. Specifically, the force giving members 60 and 61 are provided on the mounting direction upstream side than the positioning portions 14R1 and 14L1. In addition, it is preferred that the force giving member 60 and 61 be provided, in the mounting direction D1, on the depth side than a halfway position of the guide grooves 14R and 14L. With this structure, the force giving members 60 and 61 may give the force to the drawer 13, to thereby efficiently suppress the impact on mounting. Accordingly, it is preferred that the positions of the force giving members 60 and 61 in the mounting direction D1 be a downstream side than the halfway of the guide members 14R and 14L, and be an upstream side of the positioning portions 14R1 and 14L1.

In this embodiment, in order to gradually give the force to the drawer 13, the first force giving portions 60*a* and 61*a* are provided including the slope (inclined surface) to the force giving members 60 and 61. However, the slopes may be provided to the guided portions of the drawer. In such case, the first force giving portions each preferably have an arc shape. Specifically, in order to gradually weaken the impact on mounting of the drawer, it is preferred to provide urged slopes, and the slopes may be provide to the drawer, or the force giving member. Further, in order to gradually weaken the impact on mounting of the drawer, coil-like spring members 35 and 36 are provided. However, as the spring member (elastic member), a plate-like spring member and a screw coil spring may also be used.

In this embodiment, as a transfer belt 11, there is exemplified a transfer belt which conveys a recording medium S onto a surface of the drum 1, and in which the developer on the drum 1 is directly transferred onto the recording medium S. However, there may be employed an intermediate transfer belt of a system, in which the developer formed on the drum is transferred to the intermediate transfer belt, and finally retransferred onto the recording medium. In this embodiment, as an example of the cartridges P, there was given a process cartridge in which a photosensitive drum and a developing roller, and the developer are integrally included. However, the cartridges P may be a developer cartridge in which the developing roller, the developer, and the developer container are integrated, a toner cartridge, in which the developer and the developer container are integrally included, or the like.

Second Embodiment

Figure 13A:
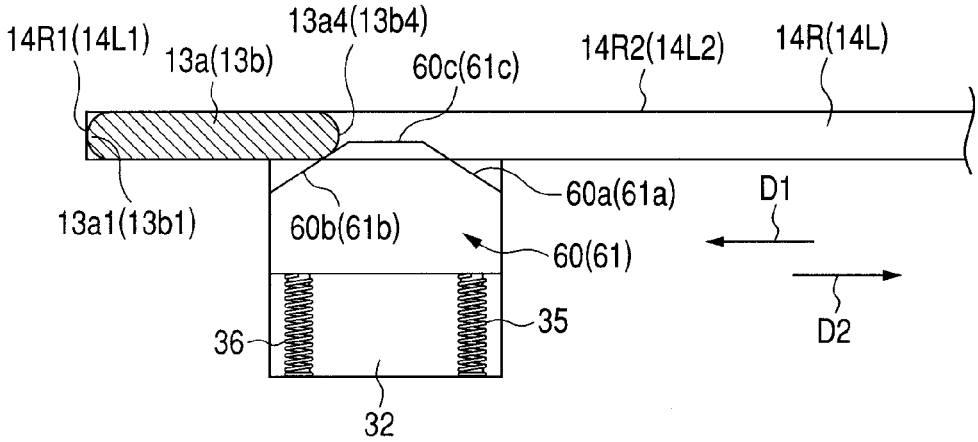
FIG. 13A is a diagram illustrating a relationship between a force giving member and a drawer according to a second embodiment of the present invention.

Next, a second embodiment will be described. Note that, in this embodiment, a description will be provided of the structure and operation, which are different from the first embodiment described above, and the members having the same structure and function are designated by the same reference symbols, and the previous description in the first embodiment is invoked. As illustrate in FIG. 13A, in this embodiment, a position of a force giving member 60 is positioned further back side as in the case of the first embodiment. Accordingly, when the drawer 13 is positioned at the inside position A, the rear end portion 13*a*4 of the guided portion 13*a* is made into a state in which the guided portion 13*a* is given a force in a mounting direction D1 by a force giving portion 60*b*. Specifically, the positioned portion 13*a*1 abuts on the positioning portion (a main body side positioning portion) 14R1, and the drawer 13 is positioned with respect to the apparatus main body 100A under a state in which a force is given to the second force giving portion 60*b* of the force giving member 60. As described above, the apparatus main body 100A includes, at the inside position A, a positioning portion 14R1 (14L1) performing the positioning of the drawer 13 with respect to the apparatus main body 100A. Then, the positioned portion 13*a*1 of the drawer 13 abuts on the positioning portion 14R1. With this, the positioned portion 13*a*1 (drawer 13) is positioned with respect to the apparatus main body 100A.

Accordingly, compared to the first embodiment, other positioning member is not separately needed. Further, the position of the drawer 13 within the apparatus main body is further stabilized. Owing to this, noise or the like due to vibration of the drawer 13 may be further suppressed. In respect to a force giving member 61, too, similar structure with the force giving member 60 may be employed.

Third Embodiment

Next, a description will be provided of a third embodiment. Note that, in this embodiment, a description will be provided of the structure and operation, which are different from the first and second embodiments described above, and the members having the same structure and function are designated by the same reference symbols, and the previous descriptions in the first and second embodiments are invoked. In the first embodiment, description was made of an example in which the force giving member 60 is urged by the springs 35 and 36 as the urging member. In this embodiment, a description will be provided of an example in which a force giving member itself is a spring having a spring property (elastically deformable spring, elastic member).

Figure 13B:
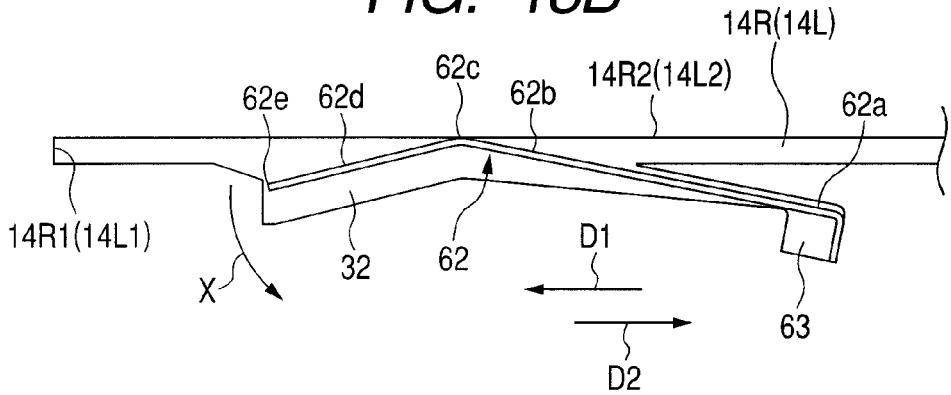
FIG. 13B is a diagram illustrating a force giving member according to a third embodiment of the present invention.

(Force Giving Member): A description will be provided of a force giving member 62 (a right side force giving member) of this embodiment with reference to FIG. 13B. FIG. 13B is a diagram in which the periphery of the right guide member 14R for guiding the drawer 13 is enlarged, and is a diagram viewed from a direction which is perpendicular to the mounting and removal direction of the drawer 13. Note that, now, a description will be provided of a force giving member 62 on a right side, but the description of a force giving member provided on a left side (opposing side) is omitted. As illustrated in FIG. 13B, with respect to the positioning portion 14R1 provided on one end side of the guide member 14R, a recess portion is provided at a forward side (upstream side) in the mounting direction (arrow D1). In the recess portion 32, a force giving member 62 is provided so as to be movable in an arrow X direction. The force giving member 62 is formed into a plate-like spring which is generally elastically deformable, and one end 62*a* is fixed to a supporting portion 63. Then, the force giving member 62 includes a first force giving portion (a resistance force giving portion) 62*b*, which is a rising slope rising toward the mounting direction D1, and a second force giving portion (a push-in force giving portion) 62*d*, which is a downward slope declining therefrom. Further, the force giving member 62 is provided with a bending portion 62*c* between the force giving portion 62*b* and the force giving portion 62*d*. Then, the force giving member 62 has a free end 62*e* at another end thereof. The force giving member 62 serves as a spring (an elastic member) exerting a restoring force as the one end 62*a* as a fulcrum when pressing the first force giving portion 62*b*, or the second force giving portion 62*d*. As the material of the force giving member 62, an SUS plate metal having a spring property is used. A force giving member 62 is urged in the guide member 14R direction due to its own spring action (elastic force), and is standing under being urged to a top surface portion 14R2. There is provided a cover (not shown) at a forward side in a vertical direction of a paper surface of the force giving member 62. With the above-mentioned cover, the force giving member 62 is adapted so as not to be removed, and the above-mentioned cover also serves as a guide portion of the drawer 13.

Figure 13C:
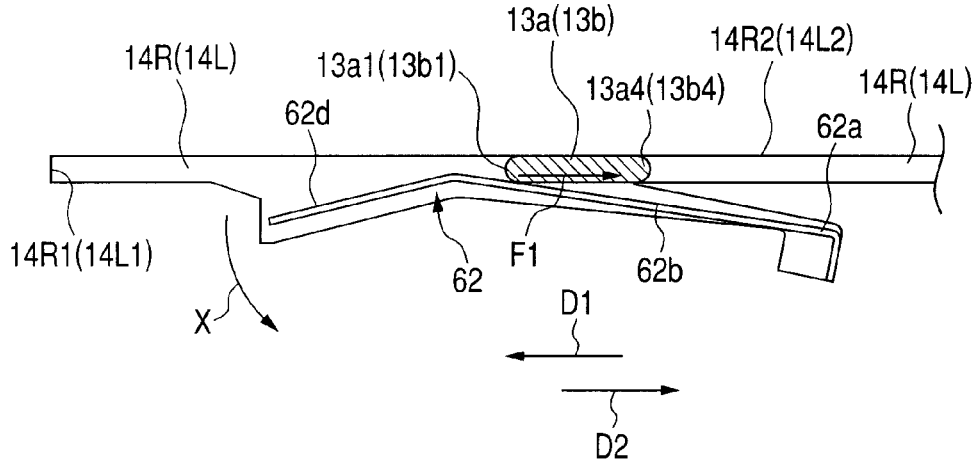
FIG. 13C is a diagram illustrating a relationship between a force giving member and a drawer according to a third embodiment of the present invention.

(Action of Force Giving Member on Drawer): FIG. 13C is a diagram at the time when the guided portion 13*a* of the drawer 13 is abutting on the first force giving portion 62*b* of the force giving member 62. The guided portion 13*a* abuts on the rising slope serving as the force giving portion 62*b*, and hence the force F1 is given to the direction D2 opposite to the mounting direction D1. The impact on mounting of the drawer 13 may be suppressed as the force F1 acts thereon. The force giving member 62 moves counter clockwise (X direction) as one end 62*a* being a center while being pressed by the guided portion 13*a*. The force F1 is gradually increased in accordance with the spring constant of the force giving member 62 along with the movement of the drawer 13 in the mounting direction (push-in direction) D1. Accordingly, when mounting the drawer 13 into the main body, the impact on mounting may be suppressed by the force giving member 62. Specifically, the impacts applied to the drawer 13 and the cartridges P may be relaxed. Thus, the braking force to be applied to a developer container 41 is also gradually given, and hence the prevention of the inner developer may be achieved. After that, by the downward slope 62*d* serving as the force giving portion 62*d*, the back end portion 13*a*4 of the guided portion 13*a* is given a force toward the mounting direction D1. Similar to the first embodiment, the user may receive an assist for mounting by the force giving member 62. As a result, the drawer 13 may be smoothly mounted. As described above, the force giving member 62 includes the force giving portion 62*b* being a rising slope which gradually rises with respect to the mounting direction D1 as being advanced to the mounting direction D1. Then, in this embodiment, the force giving member 62 itself is a spring (an elastic member) which adds the elastic force so that the force giving portion 62*b* moves in the direction in which the force giving portion 62*b* abuts against the drawer 13. Note that, as in the first embodiment, it is preferred that the inclination of the force to be given to the guided portion 13*a* be set to a proper value in accordance with each of the embodiments by changing the inclined angle of the rising slope 62*b*, or the material, length, width, thickness, or the like of the force giving member 62. By doing as such, a proper inclination may be provided to the force which is given to the drawer 13. As described above, in this embodiment, the description was provided of an example in which the force giving member 62 itself is a spring having a spring property. According to this embodiment, the number of parts may be reduced compared to the first embodiment. According to each of the above-mentioned embodiments, the force giving member 60 (61) and the force giving member 62 are arranged in the apparatus main body 100A in a direction perpendicular to the mounting direction D1, so as to abut on the one end side and the other end side of the drawer 13, which moves from the outside position B to the inside position A. Specifically, the force giving portions 60*a* (61*a*) and 60*b* (61*b*) and 62*b* and 62*d* are arranged at the above-mentioned positions.

According to each of the above-mentioned embodiments, the force giving members 60, 61, and 62 are provided to the apparatus main body 100A. Then, the force giving members 60, 61, and 62 each include the first force giving portions (the resistance force giving portion) 60*a* (61*a*) and 62*b* and the second force giving portions (the push-in force giving portion) 60*b*(61*b*) and 62*d*. The first force giving portions 60*a* (61*a*) and 62*b* each give the resistance force, which resists the advancing of the drawer 13 in the mounting direction (the push-in direction) D1, to the drawer 13 when the drawer 13 is pushed-in from the outside position B to the inside position A. Then, in the force giving members 60, 61, and 62, the resistance force increases in association with the advancing of the drawer 13 in the mounting direction D1. With this structure, the movement of the drawer 13 may smoothly be reduced in speed. As a result, when the drawer 13 is positioned in the apparatus main body 100A, the impact received from the apparatus main body 100A may be relaxed. Further, the second force giving portions (push-in force giving portion) 60*b* (61*b*) and 62*d* are arranged at the downstream sides with respect to the first force giving portions 60*a* (61*a*) and 62*b* in the mounting direction D1, thereby giving the push-in force to the drawer 13 in the mounting direction D1. With this structure, the push-in force may be assisted when the user pushes-in the drawer 13. The push-in force of the second force giving portions (push-in force giving portion) 60*b* (61*b*) and 62*d* to be given to the drawer 13 is gradually reduced in association with the advancing of the drawer 13 in the mounting direction D1. With this structure, the second force giving portions (push-in force giving portion) 60*b* (61*b*) and 62*d* may assist the push-in force when the user pushes-in the drawer 13. However, the impact to be added to the drawer 13 may further be relaxed. Further, the resistance force to be given to the drawer 13 by the first force giving portions 60*a* (61*a*) and 62*b* is gradually increased in association with the advancing of the drawer 13 in the mounting direction D1. With this, the speed of the drawer 13 may further be smoothly reduced. Further, the first force giving portions 60*a* (61*a*) and 62*b* are the rising slopes in the mounting direction D1, which rises with respect to the mounting direction D1. Further, the second force giving portions 60*b* (61*b*) and 62*d* are downward slopes declining with respect to the mounting direction D1. Then, the force giving members 60, 61, and 62 integrally include the rising slopes (60*a* and 62*b*) and the downward slopes (60*b* and 62*d*). Further, the springs (the elastic members) 35 and 36 give the elastic force with respect to the force giving members 60 and 61 so that the force giving members 60 and 61 move toward the abutment direction against the drawer 13. Then, the first force giving portions 60*a* (61*a*) and 62*b* give the resistance force with respect to the drawer 13 when the drawer 13 passes on the rising slope (60*a*). Further, the second force giving portions 60*b* (61*b*) and 62*d* give the push-in force with respect to the drawer 13, when the drawer 13 passes on the downward slope (60*b*). Note that, in this embodiment, the first force giving portions 60*a* (61*a*) and 62*b* and the second force giving portions 60*b* (61*b*) and 62*d* are provided in an integral force giving members 60 and 61 and 62, but the present invention is not limited thereto. In the present invention, the first force giving portions 60*a* (61*a*) and 62*b* and the second force giving portions 60*b* (61*b*) and 62*d* may be formed into separate members. However, in a case where those are integrally formed, the number of parts may be reduced. Note that, according to the above-mentioned respective embodiments, examples are given in which the braking force to be given to the drawer 13 (resistance force resisting advancing in push-in direction) is increased linearly. However, the present invention is not intended to limit to this. For example, the braking force to be applied to the drawer 13 may be increased step by step. However, as described in the respective embodiments, by increasing the braking force linearly, the braking force may be smoothly given thereto by the drawer 13.

<Others>

The number of the plurality of cartridges, which are arranged adjacently in one direction and supported by the drawer 13 is not limited to four of the embodiments. The number of the cartridges may be set to two or three, or five or more. Further, in the above-mentioned embodiments, there are given cases of the color image forming apparatus including the plurality of cartridges as examples, but the present invention is applicable to a monochrome image forming apparatus including a single cartridge. The contact and separation between the drum 1 and the belt 11 in the embodiments may be carried out with a system in which the drawer 13 supporting the cartridges is moved with respect to the electrostatic transfer belt unit 5. Otherwise, there may employ a system in which both the electrostatic transfer belt unit 5 and the drawer 13 are moved. Further, in the image forming apparatus of the embodiments, the electrostatic transfer belt unit 5 is used as an intermediate transfer belt unit. In addition thereto, the present invention may be adopted to a structure of the image forming apparatus in which the developer image of the respective colors, which is superimposingly transferred with respect to the intermediate transfer belt, is retransferred (secondary transfer) onto the recording medium S.

According to the above-mentioned respective embodiments, when pushing-in the drawer 13 supporting the cartridges P with respect to the apparatus main body 100A, the movement speed of the drawer 13 may be suppressed. Further, the operability at the time of pushing-in the drawer 13 with respect to the apparatus main body 100A may be enhanced. Further, a resistance force resisting the advancing of the drawer 13 in the push-in direction may be given. Further, through the reduction of the advancing speed of the drawer 13 which advances in the push-in direction, when the drawer 13 is position with respect to the apparatus main body 100A, the relaxation of the impact which the drawer 13 received from the apparatus main body 100A is realized. Further, when the user pushes-in the drawer 13 in the push-in direction, the push-in force may be assisted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-076149, filed Mar. 26, 2009, and Japanese Patent Application No. 2010-046360, filed Mar. 3, 2010, which are hereby incorporated by reference herein in their entirety.

What is claimed is:

1. An electrophotographic image forming apparatus, in which a cartridge is removably mounted to an apparatus main body to form an image on a recording medium, comprising:

a cartridge support member, which is moved, while supporting the cartridge, between an inside position, which is positioned at an inside of the apparatus main body, and is an image forming position at which the image is formed by the cartridge and an outside position, which is positioned at an outside of the apparatus main body at which the cartridge is mounted and removed;

a resistance force giving portion, which is provided in the apparatus main body, for giving, when pushing-in the cartridge support member from the outside position to the inside position, a resistance force resisting an advancing of the cartridge support member in a push-in direction, the resistance force becoming larger as the cartridge support member advances in the push-in direction;

a push-in force giving portion, which is disposed downstream of a downstream side end of the resistance force giving portion in the push-in direction, for giving a push-in force to a push-in force receiving portion of the cartridge support member in the push-in direction by contacting the push-in force receiving portion; and a main body side positioning portion configured to position the cartridge support member in the inside position with respect to the apparatus main body, the main body side positioning portion positioning the cartridge support member with a gap between the push-in force receiving portion and the push-in force giving portion.

2. The electrophotographic image forming apparatus according to claim 1, wherein the push-in force to be given to the cartridge support member by the push-in force giving portion becomes smaller in accordance with the advancing of the cartridge support member in the push-in direction.

3. The electrophotographic image forming apparatus according to claim 1, wherein the resistance force to be given to the cartridge support member by the resistance force giving portion becomes larger in accordance with the advancing of the cartridge support member in the push-in direction.

4. The electrophotographic image forming apparatus according to claim 3, wherein the resistance force giving portion comprises: a rising slope rising with respect to the push-in direction; and an elastic member, which gives an elastic force to the rising slope so that the rising slope is moved in a direction in which the rising slope abuts against the cartridge support member, and the resistance force giving portion, which gives, when the cartridge support member passes on the rising slope, the resistance force to the cartridge support member.

5. The electrophotographic image forming apparatus according to claim 1, wherein the resistance force giving portion is a rising slope rising with respect to the push-in direction, the push-in force giving portion is a downward slope declining with respect to the push-in direction, the push-in force giving portion comprises: a force giving member integrally including the rising slope and the downward slope; and an elastic member, which gives an elastic force to the force giving member so that the force giving member is moved in a direction in which the force giving member abuts against the cartridge support member, the resistance force giving portion gives, when the cartridge support member passes on the rising slope, the resistance force to the cartridge support member, and the push-in force giving portion gives, when the cartridge support member passes on the downward slope, the push-in force to the cartridge support member.

6. The electrophotographic image forming apparatus according to claim 1, wherein the resistance force giving portion comprises a rising slope rising with respect to the push-in direction with progressing in the push-in direction, and the rising slope is an elastic member, which gives an elastic force so that the rising slope is moved in a direction in which the rising slope abuts against the cartridge support member.

7. The electrophotographic image forming apparatus according to claim 1, wherein the resistance force giving portion is provided on each side in a direction perpendicular to the push-in direction, so as to abut on each of one end side and an other end side of the cartridge support member, which is moved from the outside position to the inside position.

* * * * *